US007409733B2

(12) United States Patent
Tharalson et al.

(10) Patent No.: US 7,409,733 B2
(45) Date of Patent: Aug. 12, 2008

(54) TOY STORAGE COVER FOR PORTABLE PLAY YARDS, CRIBS AND CONTAINERS

(75) Inventors: Douglas Tharalson, Agoura, CA (US); Diana Tharalson, Agoura, CA (US); Bruce Martin, Malibu, CA (US)

(73) Assignee: Arm's Reach Concepts, Inc., Malibu, CA (US)

( * ) Notice: Subject to any disclaimer, the term of this patent is extended or adjusted under 35 U.S.C. 154(b) by 0 days.

(21) Appl. No.: 11/840,353

(22) Filed: Aug. 17, 2007

(65) Prior Publication Data

US 2007/0277307 A1 Dec. 6, 2007

Related U.S. Application Data

(60) Continuation of application No. 11/133,135, filed on May 19, 2005, now abandoned, which is a continuation of application No. 10/686,206, filed on Oct. 14, 2003, now Pat. No. 6,895,611, which is a division of application No. 09/695,694, filed on Oct. 25, 2000, now Pat. No. 6,687,927.

(51) Int. Cl.
*A47D 13/06* (2006.01)
*B65D 90/00* (2006.01)

(52) U.S. Cl. ..... 5/98.1; 5/99.1; 220/495.01; 220/495.11

(58) Field of Classification Search ..... 220/495.01, 220/495.06, 495.11; 229/117.28, 117.35; 5/98.1, 99.1; 217/3 R, 3 CV
See application file for complete search history.

(56) References Cited

U.S. PATENT DOCUMENTS

| | | | | | |
|---|---|---|---|---|---|
| 2,566,790 | A * | 9/1951 | Bloomfield | 5/93.1 |
| 2,822,950 | A * | 2/1958 | Hill | 217/3 R |
| 3,438,069 | A * | 4/1969 | Long | 5/422 |
| 4,558,801 | A * | 12/1985 | Vilutis | 217/3 R |
| 4,993,551 | A * | 2/1991 | Lindsay | 206/373 |
| 5,174,447 | A * | 12/1992 | Fleming | 206/373 |
| 5,813,064 | A * | 9/1998 | Hartenstine | 5/99.1 |
| 5,941,408 | A * | 8/1999 | Sherman | 220/495.01 |
| 6,189,697 | B1 * | 2/2001 | Davis | 206/581 |
| 6,305,567 | B1 * | 10/2001 | Sulpizio | 220/495.11 |
| 6,687,927 | B1 * | 2/2004 | Tharalson et al. | 5/98.1 |
| 6,895,611 | B2 * | 5/2005 | Tharalson et al. | 5/99.1 |

* cited by examiner

*Primary Examiner*—Michael Trettel
(74) *Attorney, Agent, or Firm*—Gibbons, P.C.

(57) ABSTRACT

A toy storage cover for a portable play yard includes four outer panels shaped to surround the outer walls of the play yard attached at their top edges to four inner panels shaped to line the play yard. A floor panel joins the inner panels and is secured to the floor of the play yard by a mattress pad shaped to fit within the inner panels above the floor of the play yard. A series of pockets are attached to the outer panels of the cover. The pockets have smaller pockets within them or on their outer surfaces. Tie-down straps, fitted foot pockets or attachments through the play yard walls are used to secure the cover to the play yard. The toy storage cover may be adapted to play yards of various designs, cribs or other open topped containers.

17 Claims, 13 Drawing Sheets

TOY STORAGE COVER FOR PORTABLE PLAY YARDS, CRIBS AND CONTAINERS

RELATED APPLICATIONS

This application is a continuation of application Ser. No. 11/133,135, filed May 19, 2005, now abandoned, which is a continuation of application Ser. No. 10/686,206, filed Oct. 14, 2003, now issued as U.S. Pat. No. 6,895,611, entitled "Toy Storage Cover For Portable Play Yards, Cribs And Containers", the entire disclosure of which is incorporated herein by reference thereto as if being set forth in its entirety. Application Ser. No. 10/686,206 is a divisional application of U.S. patent application Ser. No. 09/695,694, filed Oct. 25, 2000, now issued as U.S. Pat. No. 6,687,927, entitled "Toy Storage Cover For Portable Play Yards, Cribs, And Containers", the entire disclosure of which is incorporated herein by reference there to as if being set forth in its entirely.

FIELD OF THE INVENTION

The invention pertains to storage systems and, more particularly, to a fabric device for converting a portable play yard into a storage system for a child's toys.

BACKGROUND OF THE INVENTION

Various types of storage systems and devices have been developed for organizing and storing children's toys. U.S. Pat. No. 5,360,264 issued to Crane discloses a child's play table having a reversible top providing a smooth surface on one side and a modular building block system on the other. Attached beneath the reversible surface are one or more toy storage compartments or drawers.

U.S. Pat. No. 4,527,688 issued to Jones et al., describes a storage case for toy vehicles, simulating the appearance of an automobile steering wheel. U.S. Pat. No. 4,200,197, issued to Meyer et al. illustrates a toy storage apparatus having a decorative face designed to appear as an animated creature and having a large internal cavity.

A foot pedal opens the creature's mouth for the introduction or removal of the child's toys. U.S. Pat. No. 4,103,455 issued to Silvey discloses a toy chest of animal form mounted on casters. The chest includes a mechanism that when operated by the child to open the chest will produce sounds and animated movements of features of the chest. These features are designed to encourage the child to clean up his or her room.

While other variations exist, the above-described designs for toy storage devices are typical of those encountered in the prior art. It is an objective of the present invention to provide for an alternative use for a child's play yard when no longer needed to confine a small child. It is a further objective to provide for storage of both large and small toys and similar objects while making maximum use of the external surfaces of the play yard. It is a still further objective of the invention to provide the above-described capabilities in an inexpensive and durable storage system that can be easily removed from the play yard, washed, and easily reinstalled. It is yet a further objective to provide a means to secure the storage system to the play yard to prevent shifting once toys are stored in the system.

While some of the objectives of the present invention are disclosed in the prior art, none of the inventions found include all of the requirements identified.

SUMMARY OF THE INVENTION

The present invention addresses all of the deficiencies of prior art toy storage covers for play yards, cribs or containers and satisfies all of the objectives described above.

A toy storage cover for a portable play yard providing the desired features may be constructed from the following components. A portable play yard that has a rigid frame, four protruding feet, a front wall, a back wall, a first side wall, a second side wall and a floor enclosed by the walls is provided. The toy storage cover includes four outer panels. The outer front panel has an exterior surface, an interior surface, a top edge, a bottom edge, a first side edge, and a second side edge. The outer back panel has an exterior surface, an interior surface, a top edge, a bottom edge, a first side edge, and a second side edge. The outer first side panel has an exterior surface, an interior surface, a top edge, a bottom edge, a front side edge, and a back side edge. The outer second side panel has an exterior surface, an interior surface, a top edge, a bottom edge, a front side edge, and a back side edge.

The outer front panel is joined at its first side edge to the front side edge of the outer first side panel and is joined at its second side edge to the front side edge of the outer second side panel. The outer back panel is joined at its first side edge to the back side edge of the outer first side panel and is joined at its second side edge to the back side edge of the outer second side panel.

An interior pocket is provided. The interior pocket comprises four inner panels and a floor panel. The inner front panel has an exterior surface, an interior surface, a top edge, a bottom edge, a first side edge, and a second side edge. The inner back panel has an exterior surface, an interior surface, a top edge, a bottom edge, a first side edge, and a second side edge. The inner first side panel has an exterior surface, an interior surface, a top edge, a bottom edge, a front side edge, and a back side edge. The inner second side panel has an exterior surface, an interior surface, a top edge, a bottom edge, a front side edge, and a back side edge.

The inner front panel is joined at its first side edge to the front side edge of the inner first side panel and is joined at its second side edge to the front side edge of the inner second side panel. The inner back panel is joined at its first side edge to the back side edge of the inner first side panel and is joined at its second side edge to the back side edge of the inner second side panel. The floor panel has an upper surface, a lower surface, a front edge, a back edge, a first side edge and a second side edge.

The floor panel is attached at its front edge to the bottom edge of the inner front panel, at its back edge to the bottom edge of the inner back panel, at its first side edge to the bottom edge of the inner first side panel and at its second side edge to the bottom edge of the inner second side panel. The inner front panel is attached at its top edge to the top edge of the outer front panel. The inner back panel is attached at its top edge to the top edge of the outer back panel. The inner first side panel is attached at its top edge to the top edge of the outer first side panel. The inner second side panel is attached at its top edge to the top edge of the outer second side panel.

The outer front, back, first side and second side panels are sized and shaped to fit slidably over the play yard walls when attached together. The inner front, back, first side, second side and floor panels are sized and shaped to fit slidably within the play yard walls when attached together. When the play yard is located between the inner and outer panels the interior pocket will be supported by the play yard.

In a variant of the invention, a retaining means is provided. The retaining means is formed of rigid material and is sized and shaped to fit frictionally between the inner front, back, first side and second side panels and over the floor panel, thereby securing the interior pocket downwardly within the play yard.

In another variant, the retaining means is a mattress pad that has a rigid backing.

In still another variant, means are provided for securing the toy storage cover to the play yard.

In yet another variant of the invention, the means for securing the toy storage cover to the play yard comprises means for fastening at least one of the outer panels to one of the inner panels through openings in the play yard walls.

In a further variant, the means for securing the toy storage cover to the play yard comprises straps extending from the bottom edges of the outer panels that can be tied around the protruding feet of the play yard.

In still a further variant of the invention, first, second, third and fourth foot retaining pockets are provided. The foot retaining pockets are sized, shaped and located to fit slidably over one of the feet.

The first foot retaining pocket is located at an intersection of the first side edge of the outer front panel and the front side edge of the outer first side panel on the interior surfaces of the panels adjacent their bottom edges. The second foot retaining pocket is located at an intersection of the second side edge of the outer front panel and the front side edge of the outer second side panel on the interior surfaces of the panels adjacent their bottom edges. The third foot retaining pocket is located at an intersection of the first side edge of the outer back panel and the back side edge of the outer first side panel on the interior surfaces of the panels adjacent their bottom edges. The fourth foot retaining pocket is located at an intersection of the second side edge of the outer back panel and the back side edge of the outer second side panel on the interior surfaces of the panels adjacent their bottom edges.

When the feet of the play yard are positioned within the foot retaining pockets, the outer panels will be held down despite shifting loads placed in the interior pocket.

In another variant, the toy storage cover for a portable play yard includes a series of exterior pockets attached to the outer panels.

In still another variant, the outer and inner panels are formed of material through which a user can see.

In a further variant of the invention, at least one of the exterior pockets attached to the outer panels further comprises at least one smaller interior pocket or smaller exterior pocket.

In yet a further variant, a toy storage cover for a portable play yard, includes a portable play yard. The play yard has a rigid frame with three protruding feet, a first side wall, a second side wall, a third side wall and a floor enclosed by the walls. The toy storage cover has three outer panels. Each of the outer first side, second side and third side panels has an exterior surface, an interior surface, a top edge, a bottom edge, a first side edge, and a second side edge.

The outer first side panel is joined at its first side edge to the second side edge of the outer third side panel and is joined at its second side edge to the first side edge of the outer second side panel. The outer second side panel is joined at its second side edge to the first side edge of the outer third side panel.

An interior pocket including three inner panels is provided. Each of the inner first side, second side and third side panels has an exterior surface, an interior surface, a top edge, a bottom edge, a first side edge, and a second side edge. The inner first side panel is joined at its first side edge to the second side edge of the inner third side panel and is joined at its second side edge to the first side edge of the inner second side panel. The inner second side panel is joined at its second side edge to the first side edge of the inner third side panel.

A floor panel is provided. The floor panel has an upper surface, a lower surface, a first edge, a second edge, and a third edge. The floor panel is attached at its first edge to the bottom edge of the inner first side panel, at its second edge to the bottom edge of the inner second side panel, at its third edge to the bottom edge of the inner third side panel. The inner first side panel is attached at its top edge to the top edge of the outer first side panel. The inner second side panel is attached at its top edge to the top edge of the outer second side panel. The inner third side panel is attached at its top edge to the top edge of the outer third side panel.

The outer first side, second side and third side panels are sized and shaped to fit slidably over the play yard walls when attached together. The inner first side, second side and third side panels and floor panel are sized and shaped to fit slidably within the play yard walls when attached together. When the play yard is located between the inner and outer panels the interior pocket will be supported by the play yard.

In still a further variant of the invention, the toy storage cover for a portable play yard further comprises a retaining means. The retaining means is formed of rigid material and is sized and shaped to fit frictionally between the inner first side, second side and third side panels and over the floor panel, thereby securing the interior pocket downwardly within the play yard.

In another variant, the retaining means is a mattress pad that has a rigid backing.

In a further variant of the invention, a toy storage cover for a portable play yard includes a portable play yard. The play yard includes a rigid frame that has protruding feet, a surrounding side wall and a floor enclosed by the wall.

The toy storage cover includes an outer surrounding side panel and an interior pocket. The outer surrounding side panel has an exterior surface, an interior surface, a top edge and a bottom edge. The interior pocket includes an inner surrounding side panel and a floor panel. The inner surrounding side panel has an exterior surface, an interior surface, a top edge and a bottom edge. The floor panel has an upper surface, a lower surface and a surrounding edge. The floor panel is attached at its surrounding edge to the bottom edge of the inner surrounding side panel.

The inner surrounding side panel is attached at its top edge to the top edge of the outer surrounding side panel. The outer surrounding side panel is sized and shaped to fit slidably over the surrounding side wall of the play yard. The inner surrounding side panel and floor panel are sized and shaped to fit slidably within the play yard walls. When the play yard is located between the inner and outer surrounding side panels the interior pocket will be supported by the play yard.

In still a further variant, the toy storage cover for a portable play yard further comprises a retaining means. The retaining means is formed of rigid material and is sized and shaped to fit frictionally within the inner surrounding side panel and over the floor panel, thereby securing the interior pocket downwardly within the play yard.

In yet a further variant, the retaining means is a mattress pad that has a rigid backing.

In another variant of the invention, a toy storage cover for an open topped container includes a container comprising a floor, a rigid surrounding side wall extending upwardly from the floor. The toy storage cover includes an outer surrounding side panel and an interior pocket. The outer surrounding side panel has an exterior surface, an interior surface, a top edge and a bottom edge.

The interior pocket includes an inner surrounding side panel and a floor panel. The inner surrounding side panel has an exterior surface, an interior surface, a top edge and a bottom edge. The floor panel has an upper surface, a lower surface and a surrounding edge. The floor panel is attached at its surrounding edge to the bottom edge of the inner surrounding side panel. The inner surrounding side panel is attached at its top edge to the top edge of the outer surrounding side panel.

The outer surrounding side panel is sized and shaped to fit slidably over the rigid surrounding side wall of the container. The inner surrounding side panel and floor panel are sized and shaped to fit slidably within the container. When the container is located between the inner and outer surrounding side panels the interior pocket will be supported by the container.

In still another variant, the toy storage cover for an open topped container further comprises a retaining means. The retaining means is formed of rigid material and is sized and shaped to fit frictionally within the inner surrounding side panel and over the floor panel, thereby securing the interior pocket downwardly within the container.

In a further variant of the invention, the retaining means is a mattress pad that has a rigid backing.

In yet another variant, a toy storage cover for a crib includes a crib. The crib includes a rigid frame and has four protruding feet, a front wall, a back wall, a first side wall, a second side wall and a floor enclosed by the walls. The toy storage cover includes four outer panels, an outer front panel, an outer back panel, an outer first side panel and an outer second side panel. The outer panels are attached to each other at their side edges.

The toy storage cover includes an interior pocket that includes four inner panels, an inner front panel, an inner back panel, an inner first side panel and an inner second side panel and a floor panel. The four inner panels are attached to each other at their side edges and to the floor panel at their bottom edges. The inner panels are attached at their top edges to the top edges of the outer panels. The outer front, back, first side and second side panels are sized and shaped to fit slidably over the crib walls when attached together. The inner front, back, first side, second side and floor panels are sized and shaped to fit slidably within the crib walls when attached together. When the crib is located between the inner and outer panels the interior pocket will be supported by the crib.

In still another variant of the invention, the toy storage cover for a crib further comprises a retaining means. The retaining means is formed of rigid material and is sized and shaped to fit frictionally between the inner front, back, first side and second side panels and over the floor panel, thereby securing the interior pocket downwardly within the crib.

In a further variant, the retaining means is a mattress pad has a rigid backing.

In another variant of the invention, a toy storage cover for a collapsible open topped container includes a container. The container includes a front wall, a back wall, a first side wall, a second side wall and a floor enclosed by the walls. Each of the walls has a top edge, a bottom edge, a first side edge, a second side edge, an inner surface and an outer surface. The floor has a front edge, a back edge, a first side edge, a second side edge, a top surface and a bottom surface.

The front wall is hingedly attached at its bottom edge to the front edge of the floor and the back wall is hingedly attached at its bottom edge to the back edge of the floor. The first side wall is hingedly attached at its bottom edge to the first side edge of the floor and the second side wall is hingedly attached at its bottom edge to the second side edge of the floor.

Means are provided for removably attaching the front wall at its first side edge to the first side wall at its second side edge. Means are provided for removably attaching the front wall at its second side edge to the second side wall at its first side edge. Means are provided for removably attaching the back wall at its second side edge to the first side wall at its first side edge. Means are provided for removably attaching the back wall at its first side edge to the second side wall at its second side edge.

The toy storage cover includes four outer panels. The outer front panel has an exterior surface, an interior surface, a top edge, a bottom edge, a first side edge, and a second side edge. The outer back panel has an exterior surface, an interior surface, a top edge, a bottom edge, a first side edge, and a second side edge. The outer first side panel has an exterior surface, an interior surface, a top edge, a bottom edge, a front side edge, and a back side edge. The outer second side panel has an exterior surface, an interior surface, a top edge, a bottom edge, a front side edge, and a back side edge.

The outer front panel is joined at its first side edge to the front side edge of the outer first side panel and is joined at its second side edge to the front side edge of the outer second side panel. The outer back panel is joined at its first side edge to the back side edge of the outer first side panel and is joined at its second side edge to the back side edge of the outer second side panel.

An interior pocket is provided. The interior pocket includes four inner panels and a floor panel. The inner front panel has an exterior surface, an interior surface, a top edge, a bottom edge, a first side edge, and a second side edge. The inner back panel has an exterior surface, an interior surface, a top edge, a bottom edge, a first side edge, and a second side edge. The inner first side panel has an exterior surface, an interior surface, a top edge, a bottom edge, a front side edge, and a back side edge. The inner second side panel has an exterior surface, an interior surface, a top edge, a bottom edge, a front side edge, and a back side edge.

The inner front panel is joined at its first side edge to the front side edge of the inner first side panel and is joined at its second side edge to the front side edge of the inner second side panel. The inner back panel is joined at its first side edge to the back side edge of the inner first side panel and is joined at its second side edge to the back side edge of the inner second side panel.

The floor panel has an upper surface, a lower surface, a front edge, a back edge, a first side edge and a second side edge. The floor panel is attached at its front edge to the bottom edge of the inner front panel, at its back edge to the bottom edge of the inner back panel, at its first side edge to the bottom edge of the inner first side panel and at its second side edge to the bottom edge of the inner second side panel. The inner front panel is attached at its top edge to the top edge of the outer front panel. The inner back panel is attached at its top edge to the top edge of the outer back panel. The inner first side panel is attached at its top edge to the top edge of the outer first side panel. The inner second side panel is attached at its top edge to the top edge of the outer second side panel.

The outer front, back, first side and second side panels are sized and shaped to fit slidably over the container walls when attached together. The inner front, back, first side, second side and floor panels are sized and shaped to fit slidably within the container walls when attached together. When the container is located between the inner and outer panels the interior pocket will be supported by the container.

In still another variant, the toy storage cover includes at least one attachment strap. The attachment strap has a first end and a second end and is fixedly attached at its first end to the lower surface of the floor panel of the interior pocket. The strap extends outwardly past one of the inner panels. The second end of the attachment strap includes means for removably attaching the second end to either the exterior surface or the interior surface of one of the outer panels.

The container includes at least one slot. The slot is sized, shaped and located adjacent the bottom edge of one of the walls of the collapsible container so as to permit the second end of the attachment strap to pass through it. When the second end of the attachment strap is passed through the slot and removably attached to either the exterior surface or the interior surface of at least one of the outer panels, the interior pocket of the toy storage cover will be removably secured to the collapsible container.

In yet another variant, the means for removably attaching the front and back walls of the container to the first and second side walls of the container includes hooking and loop elements secured to either the inner surface or the outer surface of the walls adjacent their side edges.

In a further variant of the invention, the means for removably attaching the second end of the attachment strap to either the exterior surface or the interior surface of one of the outer panels includes hooking and loop elements secured to the second end and either the exterior surface or the interior surface of at least one of the outer panels.

In still a further variant, a retaining means is provided. The retaining means is formed of rigid material and is sized and shaped to fit frictionally between the inner front, back, first side and second side panels and over the floor panel, thereby securing the interior pocket downwardly within the container.

In yet a further variant, the retaining means is a mattress pad that has a rigid backing.

In another variant of the invention, the toy storage cover for a collapsible open topped container includes means for securing the toy storage cover to the container.

In a final variant, the means for securing the toy storage cover to the container comprises means for fastening at least one of the outer panels to one of the inner panels through openings in the container walls.

An appreciation of the other aims and objectives of the present invention and an understanding of it may be achieved by referring to the accompanying drawings and the detailed description of a preferred embodiment.

BRIEF DESCRIPTION OF THE FIGURES

Understanding of the present invention will be facilitated by consideration of the following detailed description of the preferred embodiments of the present invention taken in conjunction with the accompanying drawings, in which like numerals refer to like parts.

DETAILED DESCRIPTION OF THE PREFERRED EMBODIMENTS

It is to be understood that the figures and descriptions of the present invention have been simplified to illustrate elements that are relevant for a clear understanding of the present invention, while eliminating, for the purpose of clarity, many other elements found in toy storage covers. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the art.

Figure 1:
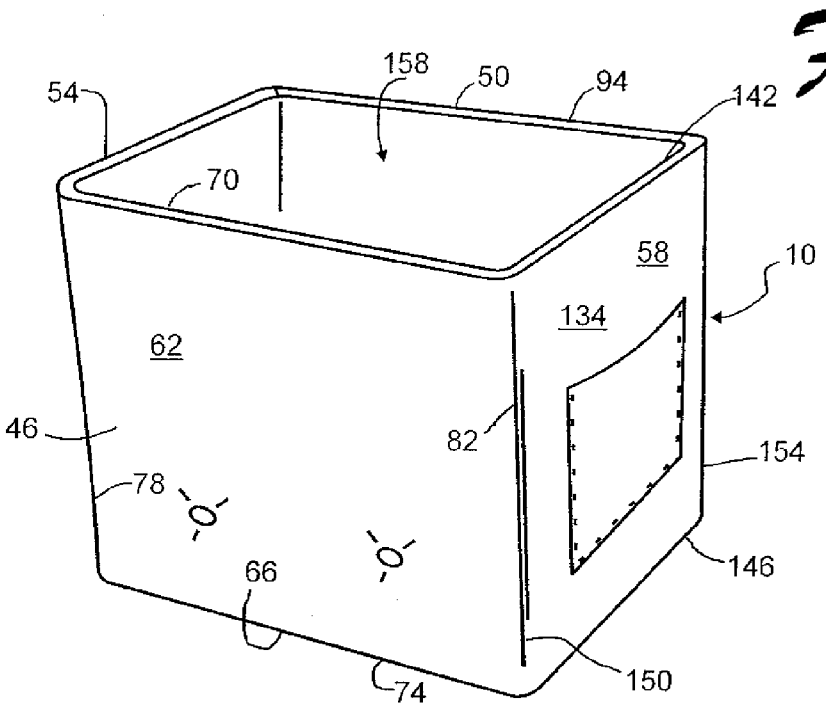
FIG. 1 is a perspective view of the preferred embodiment of the invention disposed upon a portable play yard.
Figure 2:
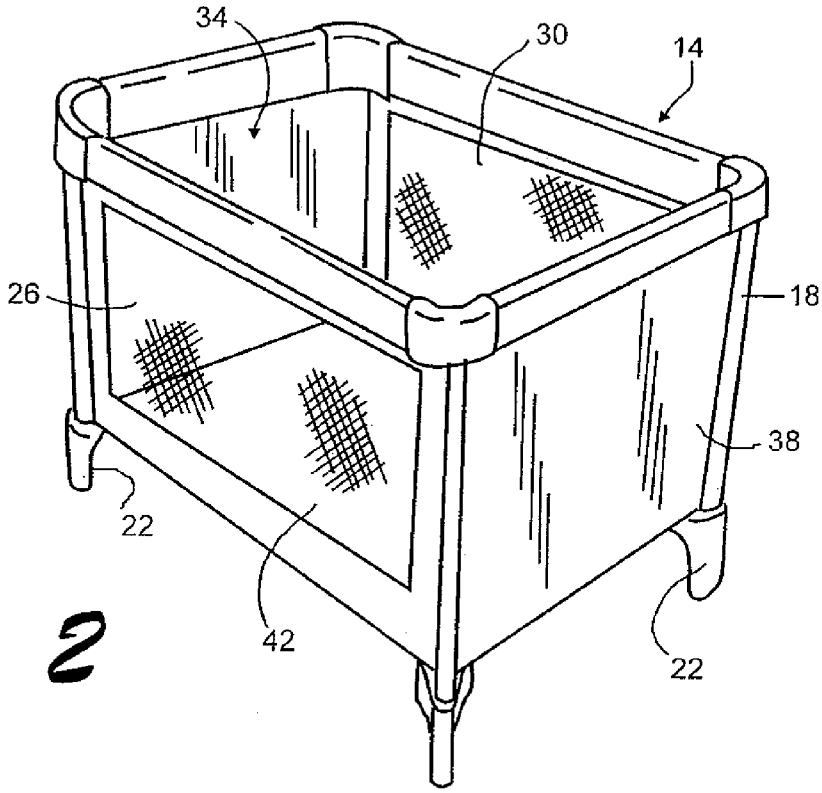
FIG. 2 is a perspective view of the play yard.
Figure 3:
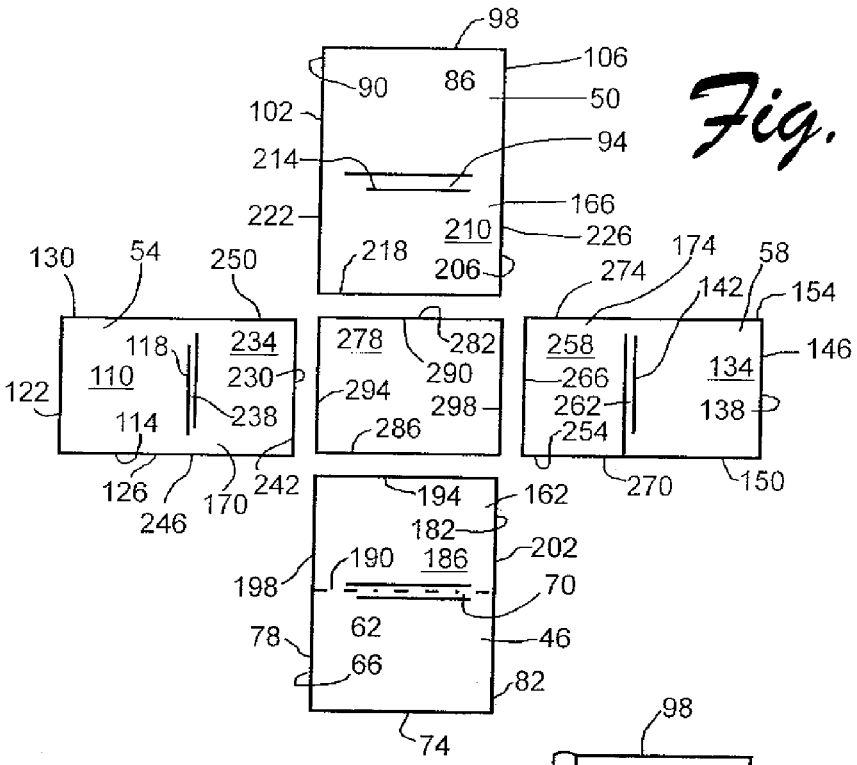
FIG. 3 is a plan view layout of the outer, inner and floor panels of the FIG. 1 embodiment.

FIGS. 1-10 illustrate a toy storage cover for a portable play yard 10 providing the desired features that may be constructed from the following components. A portable play yard 14, as illustrated in FIG. 2, that has a rigid frame 18, four protruding feet 22, a front wall 26, a back wall 30, a first side wall 34, a second side wall 38 and a floor 42 enclosed by the walls 26, 30, 34, 38 is provided. As illustrated in FIGS. 1 and 3, the toy storage cover 10 includes four outer panels 46, 50, 54, 58. The outer front panel 46 has an exterior surface 62, an interior surface 66, a top edge 70, a bottom edge 74, a first side edge 78, and a second side edge 82. The outer back panel 50 has an exterior surface 86, an interior surface go, a top edge 94, a bottom edge 98, a first side edge 102, and a second side edge 106. The outer first side panel 54 has an exterior surface 110, an interior surface 114, a top edge 118, a bottom edge 122, a front side edge 126, and a back side edge 130. The outer second side panel 58 has an exterior surface 134, an interior surface 138, a top edge 142, a bottom edge 146, a front side edge 150, and a back side edge 154.

The outer front panel 46 is joined at its first side edge 78 to the front side edge 126 of the outer first side panel 54 and is joined at its second side edge 82 to the front side edge 150 of the outer second side panel 58. The outer back panel 50 is joined at its first side edge 102 to the back side edge 130 of the outer first side panel 54 and is joined at its second side edge 106 to the back side edge 154 of the outer second side panel 58.

An interior pocket 158 is provided. The interior pocket 158 comprises four inner panels 162, 166, 170, 174 and a floor panel 178. The inner front panel 162 has an exterior surface 182, an interior surface 186, a top edge 190, a bottom edge 194, a first side edge 198, and a second side edge 202. The inner back panel 166 has an exterior surface 206, an interior surface 210, a top edge 214, a bottom edge 218, a first side edge 222, and a second side edge 226. The inner first side panel 170 has an exterior surface 230, an interior surface 234, a top edge 238, a bottom edge 242, a front side edge 246, and a back side edge 250. The inner second side panel 174 has an exterior surface 254, an interior surface 258, a top edge 262, a bottom edge 266, a front side edge 270, and a back side edge 274.

The inner front panel 162 is joined at its first side edge 198 to the front side edge 246 of the inner first side panel 170 and is joined at its second side edge 202 to the front side edge 270 of the inner second side panel 174. The inner back panel 166 is joined at its first side edge 222 to the back side edge 250 of the inner first side panel 170 and is joined at its second side edge 226 to the back side edge 274 of the inner second side panel 174. The floor panel 178 has an upper surface 278, a lower surface 282, a front edge 286, a back edge 290, a first side edge 294 and a second side edge 298.

The floor panel 178 is attached at its front edge 286 to the bottom edge 194 of the inner front panel 162, at its back edge 290 to the bottom edge 218 of the inner back panel 166, at its first side edge 294 to the bottom edge 242 of the inner first side panel 170 and at its second side edge 298 to the bottom edge 266 of the inner second side panel 174. The inner front panel 162 is attached at its top edge 190 to the top edge 70 of the outer front panel 46. The inner back panel 166 is attached at its top edge 214 to the top edge 94 of the outer back panel 50. The inner first side panel 170 is attached at its top edge 238 to the top edge 118 of the outer first side panel 54. The inner second side panel 174 is attached at its top edge 262 to the top edge 142 of the outer second side panel 58.

The outer front 46, back 50, first side 54 and second side 58 panels are sized and shaped to fit slidably over the play yard walls 26, 30, 34, 38 when attached together. The inner front 162, back 166, first side 170, second side 174 and floor panels 178 are sized and shaped to fit slidably within the play yard walls 26, 30, 34, 38 when attached together. When the play yard 10 is located between the inner 162, 166, 170, 174 and outer 46, 50, 54, 58 panels the interior pocket 158 will be supported by the play yard 14.

Figure 4:
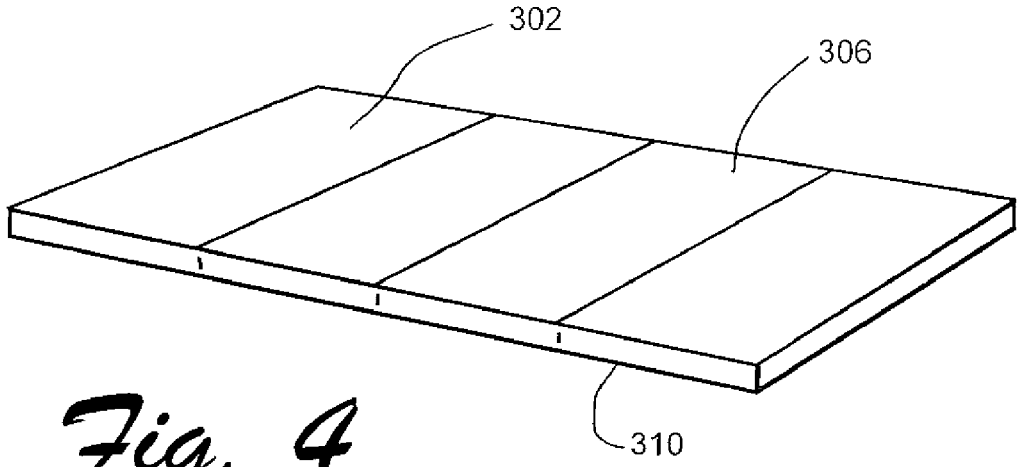
FIG. 4 is perspective view of the mattress pad retaining means for the FIG. 1.

In a variant of the invention, as illustrated in FIG. 4, a retaining means 302 is provided. The retaining means 302 is formed of rigid material and is sized and shaped to fit frictionally between the inner front 162, back 166, first side 170 and second side 174 panels and over the floor panel 178, thereby securing the interior pocket 158 downwardly within the play yard 14.

In another variant, the retaining means 302 is a mattress pad 306 that has a rigid backing 310.

Figure 5:
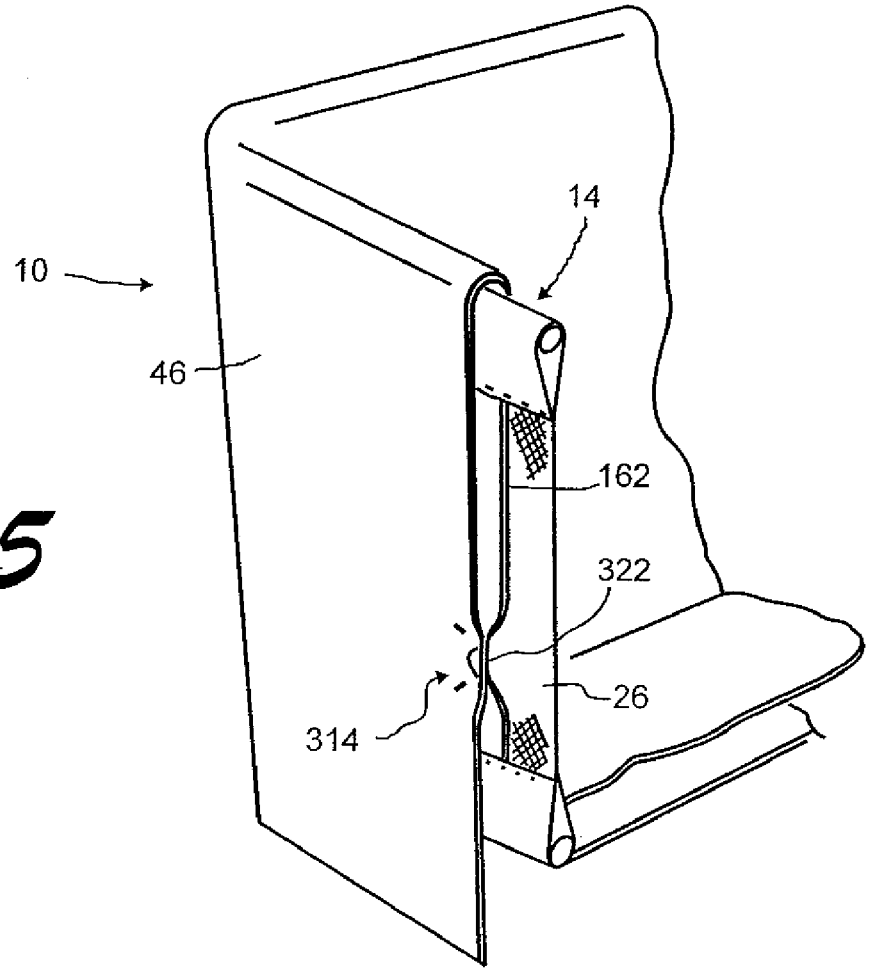
FIG. 5 is a perspective view of the FIG. 1 embodiment illustrating attachment of the outer panels to the inner panels through openings in the play yard walls.
Figure 7:
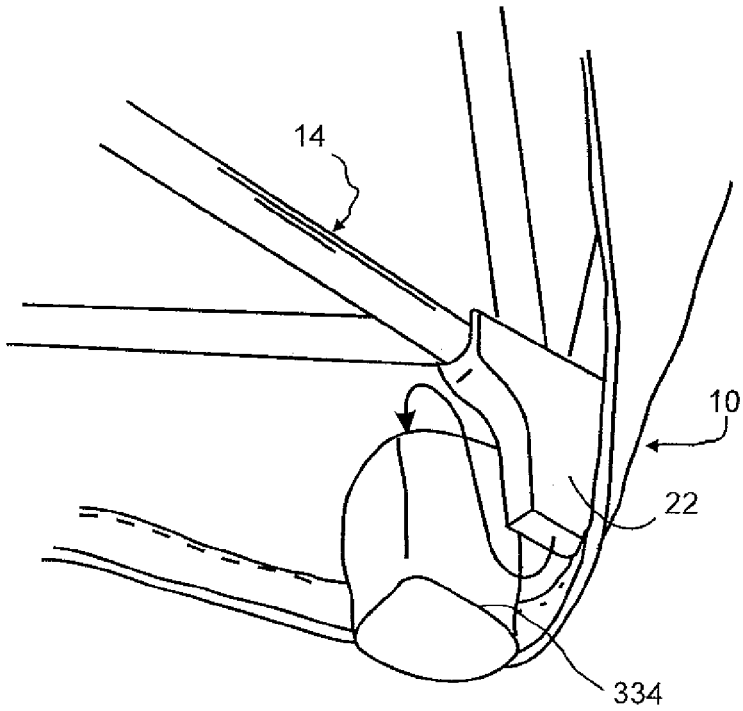
FIG. 7 is a perspective view of the FIG. 1 embodiment illustrating attachment of the cover to the play yard by means of pockets for enclosing the protruding feet of the play yard.

In still another variant, as illustrated in FIGS. 5 and 7, means 314 are provided for securing the toy storage cover 10 to the play yard 14.

In yet another variant of the invention, as illustrated in FIG. 5, the means 314 for securing the toy storage cover 10 to the play yard 14 comprises means 318 for fastening at least one of the outer panels 46, 50, 54, 58 to one of the inner panels 162, 166, 170, 174 through openings 322 in the play yard walls 26, 30, 34, 38.

Figure 6:
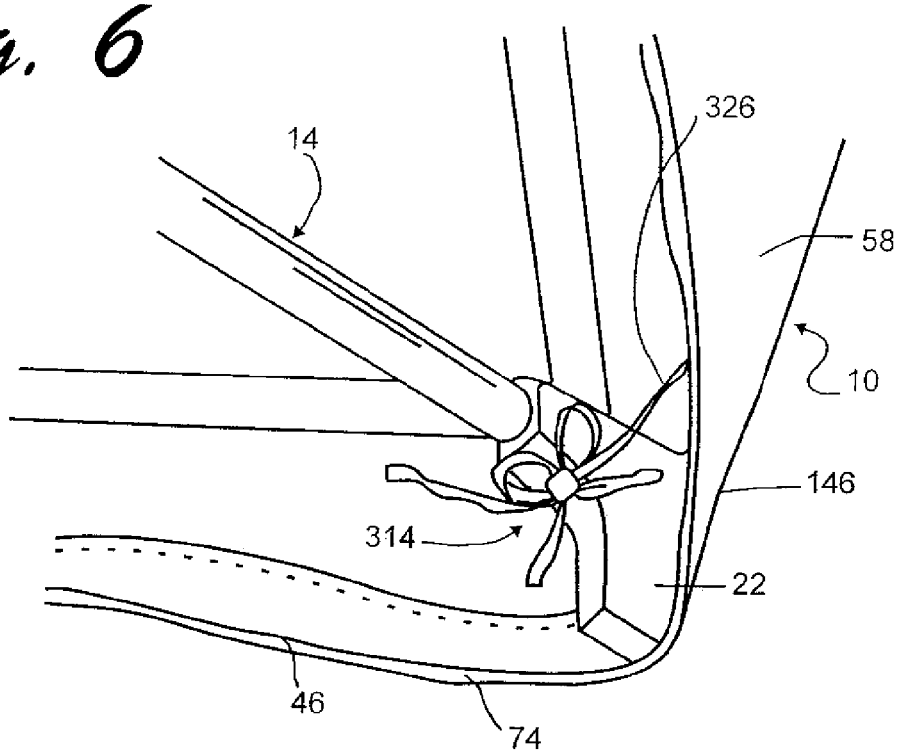
FIG. 6 is a perspective view of the FIG. 1 embodiment illustrating attachment of the cover to the play yard by means of straps tied around the feet of the play yard.

In a further variant, as illustrated in FIG. 6, the means 314 for securing the toy storage cover 10 to the play yard 14 comprises straps 326 extending from the bottom edges 74, 98, 122, 146 of the outer panels 46, 50, 54, 58 that can be tied around the protruding feet 22 of the play yard 14.

In still a further variant of the invention, as illustrated in FIG. 7, first 330, second 334, third 338 and fourth 342 foot retaining pockets are provided. The foot retaining pockets 330, 334, 338, 342 are sized, shaped and located to fit slidably over one of the feet 22.

Figure 3A:
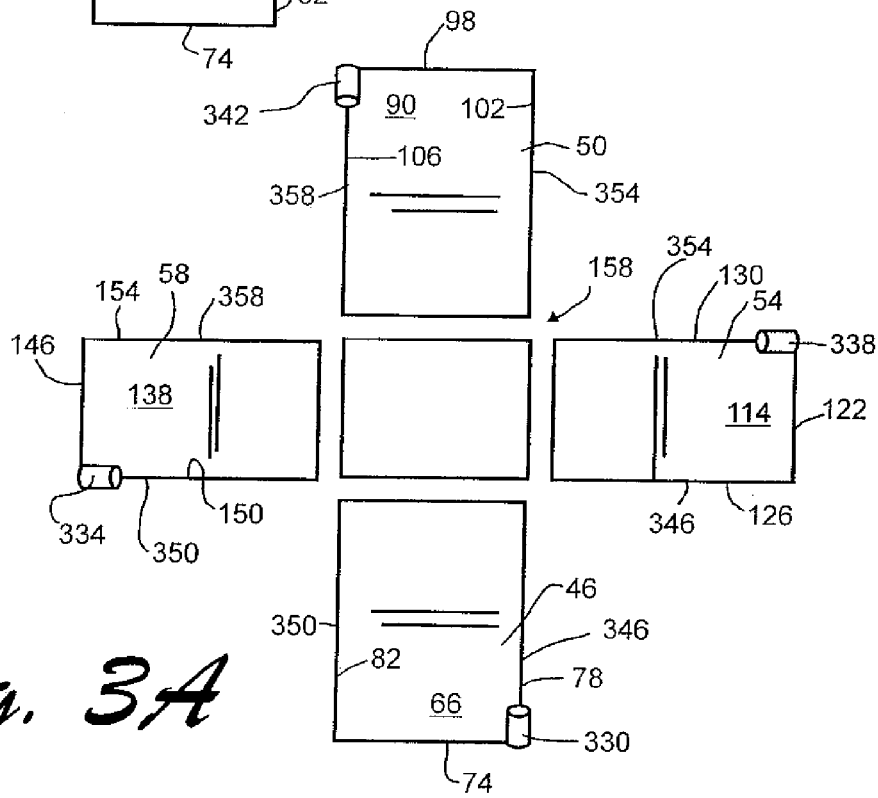
FIG. 3*a* is a plan view layout of the outer, inner and floor panels of the FIG. 1 embodiment as seen from below illustrating the placement of the foot pockets.

As illustrated in FIG. 3*a*, the first foot retaining pocket 330 is located at an intersection 346 of the first side edge 78 of the outer front panel 46 and the front side edge 126 of the outer first side panel 54 on the interior surfaces 66, 114 of the panels 46, 54 adjacent their bottom edges 74, 122. The second foot retaining pocket 334 is located at an intersection 350 of the second side edge 82 of the outer front panel 46 and the front side edge 150 of the outer second side panel 58 on the interior surfaces 66, 138 of the panels 46, 58 adjacent their bottom edges 74, 146. The third foot retaining pocket 338 is located at an intersection 354 of the first side edge 102 of the outer back panel 50 and the back side edge 130 of the outer first side panel 54 on the interior surfaces go, 114 of the panels 50, 54 adjacent their bottom edges 98, 122. The fourth foot retaining pocket 342 is located at an intersection 358 of the second side edge 106 of the outer back panel 50 and the back side edge 154 of the outer second side panel 58 on the interior surfaces 90, 138 of the panels 50, 58 adjacent their bottom edges 98, 146.

When the feet 22 of the play yard 14 are positioned within the foot retaining pockets 330, 334, 338, 342, the outer panels 46, 50, 54, 58 will be held down despite shifting loads placed in the interior pocket 158.

Figure 8:
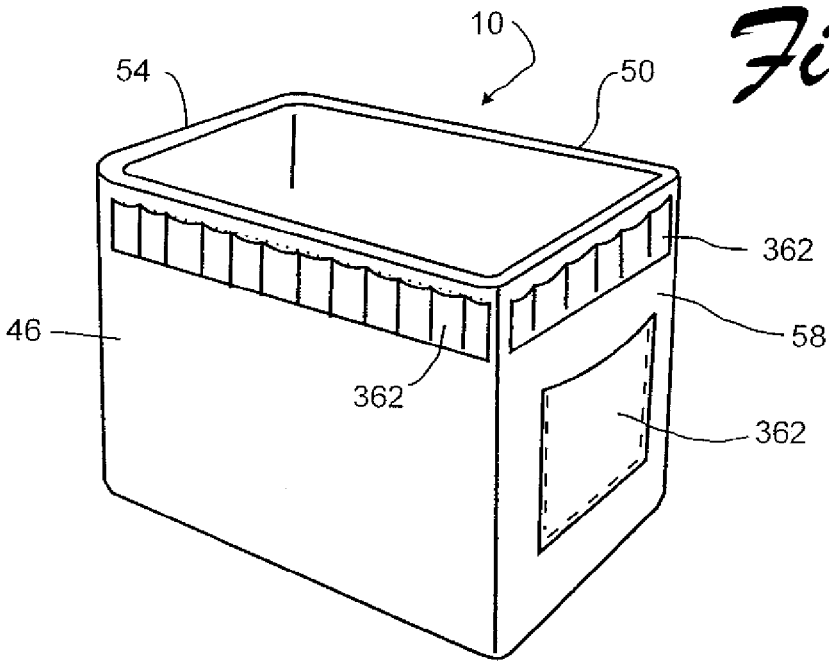
FIG. 8 is a perspective view of the FIG. 1 embodiment illustrating a plurality of pockets affixed to the outer panels.

In another variant, as illustrated in FIG. 8, the toy storage cover 10 for a portable play yard 14 includes a series of exterior pockets 362 attached to the outer panels 46, 50, 54, 58.

Figure 9:
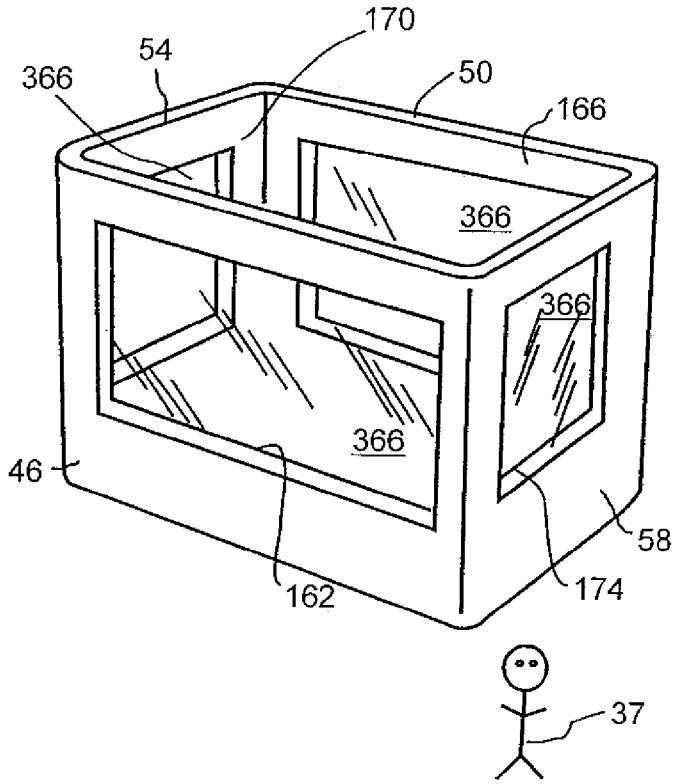
FIG. 9 is a perspective view of the FIG. 1 embodiment illustrating see-through inner and outer panels.

In still another variant, as illustrated in FIG. 9, the outer 46, 50, 54, 58 and inner 162, 166, 170, 174 panels are formed of material 366 through which a user 370 can see.

Figure 10:
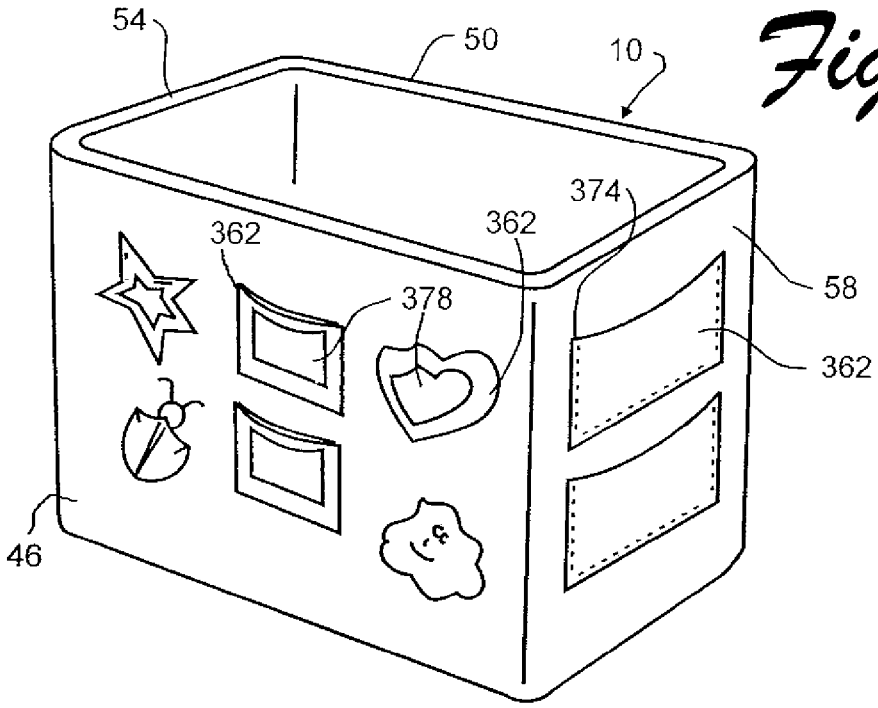
FIG. 10 is a detail perspective view of a portion of the FIG. 1 embodiment illustrating smaller pockets attached to the inside and outside of larger pockets.

In a further variant of the invention, as illustrated in FIG. 10, at least one of the exterior pockets 362 attached to the outer panels 46, 50, 54, 58 further comprises at least one smaller interior pocket 374 or smaller exterior pocket 378.

Figure 11:
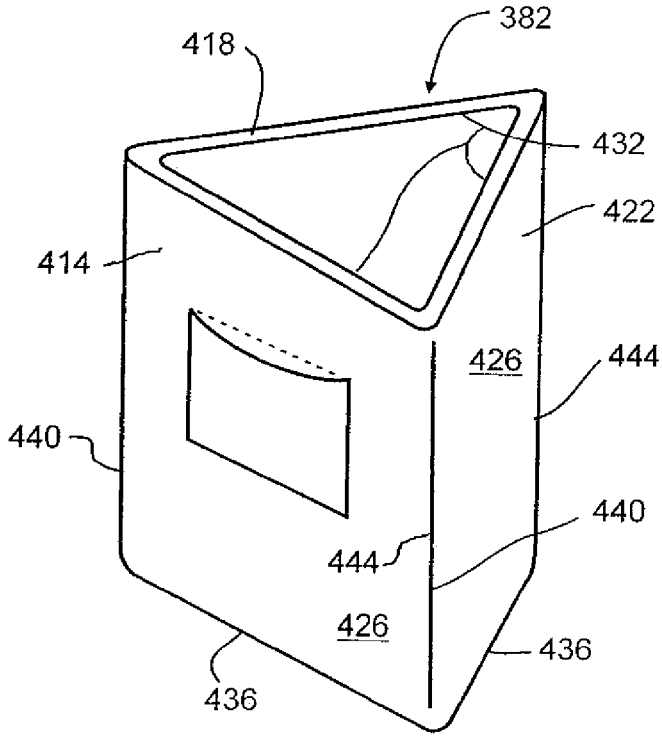
FIG. 11 is a perspective view of a second embodiment of the invention disposed upon a portable play yard having three sides.
Figure 12:
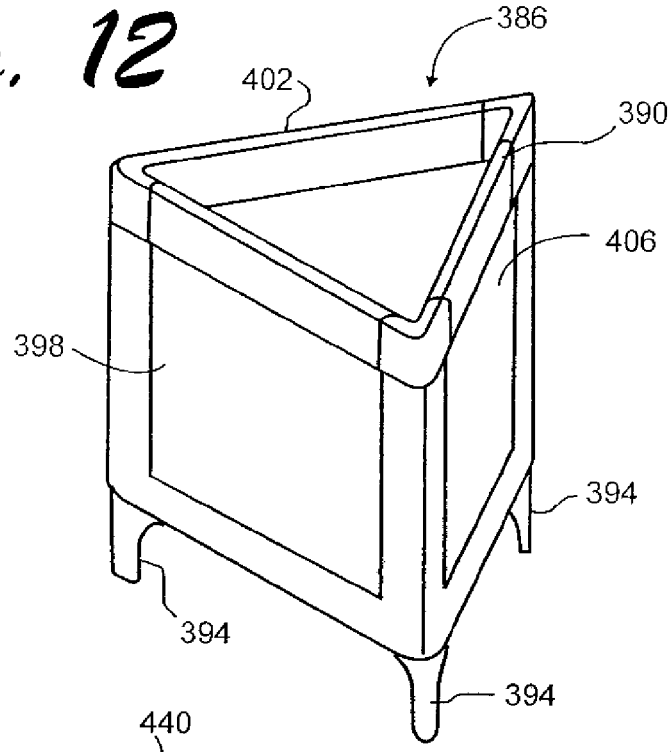
FIG. 12 is a perspective view of the three-sided play yard.
Figure 12:
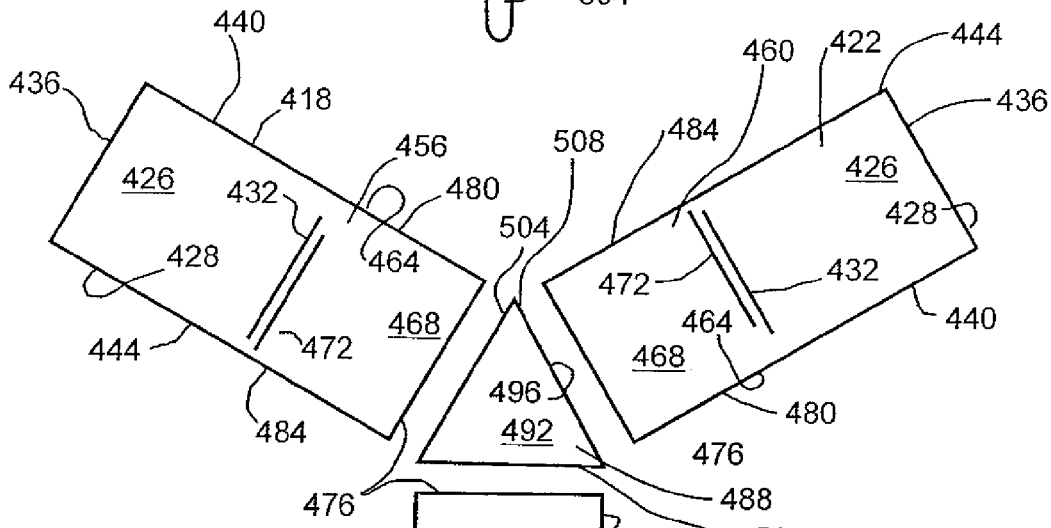
Figure 13:
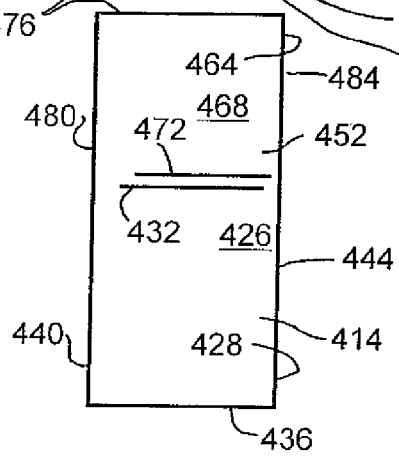
FIG. 13 is a plan view layout of the outer, inner and floor panels of the FIG. 11 embodiment.

In yet a further variant, as illustrated in FIGS. 11-14, a toy storage cover 382 for a portable play yard, includes a portable play yard 386. The play yard 386, as illustrated in FIG. 12, has a rigid frame 390 with three protruding feet 394, a first side wall 398, a second side wall 402, a third side wall 406 and a floor 410 enclosed by the walls 398, 402, 406. The toy storage cover 382 has three outer panels 414, 418, 422. As illustrated in FIGS. 11 and 13, each of the outer first side 414, second side 418 and third side 422 panels has an exterior surface 426, an interior surface 428, a top edge 432, a bottom edge 436, a first side edge 440, and a second side edge 444.

The outer first side panel 414 is joined at its first side edge 440 to the second side edge 444 of the outer third side panel 422 and is joined at its second side edge 444 to the first side edge 440 of the outer second side panel 418. The outer second side panel 418 is joined at its second side edge 444 to the first side edge 440 of the outer third side panel 422.

An interior pocket 448 including three inner panels 452, 456, 460 is provided. Each of the inner first side, second side and third side panels 452, 456, 460 has an exterior surface 464, an interior surface 468, a top edge 472, a bottom edge 476, a first side edge 480, and a second side edge 484. The inner first side panel 452 is joined at its first side edge 480 to the second side edge 484 of the inner third side panel 460 and is joined at its second side edge 484 to the first side edge 480 of the inner second side panel 456. The inner second side panel 456 is joined at its second side edge 484 to the first side edge 480 of the inner third side panel 460.

A floor panel 488 is provided. The floor panel 488 has an upper surface 492, a lower surface 496, a first edge 500, a second edge 504, and a third edge 508. The floor panel 488 is attached at its first edge 500 to the bottom edge 476 of the inner first side panel 452, at its second edge 504 to the bottom edge 476 of the inner second side panel 456, at its third edge 508 to the bottom edge 476 of the inner third side panel 460. The inner first side panel 452 is attached at its top edge 472 to the top edge 432 of the outer first side panel 414. The inner second side panel 456 is attached at its top edge 472 to the top edge 432 of the outer second side panel 418. The inner third side panel 460 is attached at its top edge 472 to the top edge 432 of the outer third side panel 422.

The outer first side 414, second side 418 and third side 422 panels are sized and shaped to fit slidably over the play yard walls 398, 402, 406 when attached together. The inner first side 452, second side 456 and third side 460 panels and floor panel 488 are sized and shaped to fit slidably within the play yard walls 398, 402, 406 when attached together. When the play yard 386 is located between the inner 452, 456, 460 and outer 414, 418, 422 panels the interior pocket 448 will be supported by the play yard 386.

Figure 14:
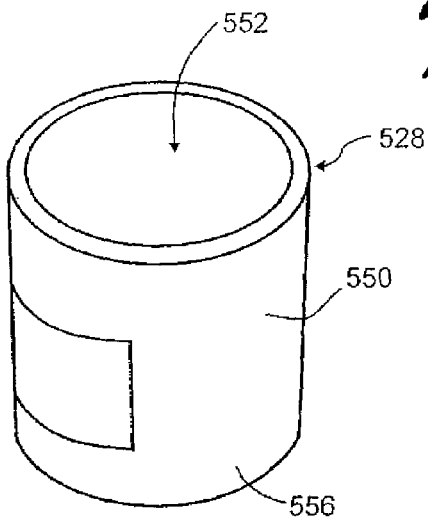
FIG. 14 is perspective view of the mattress pad retaining means for the FIG. 11 embodiment.

In still a further variant of the invention, as illustrated in FIG. 14, the toy storage cover 382 for a portable play yard 386 further comprises a retaining means 512. The retaining means 512 is formed of rigid material 516 and is sized and shaped to fit frictionally between the inner first side 452, second side 456 and third side 460 panels and over the floor panel 488, thereby securing the interior pocket 448 downwardly within the play yard 386.

In another variant, the retaining means 512 is a mattress pad 520 that has a rigid backing 524.

Figure 15:
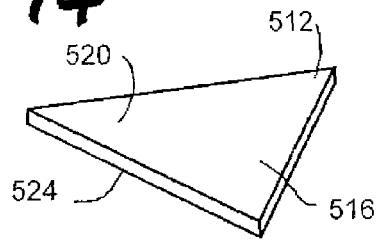
FIG. 15 is a perspective view of a third embodiment of the invention disposed upon a portable play yard having a curved surrounding outer wall.
Figure 16:
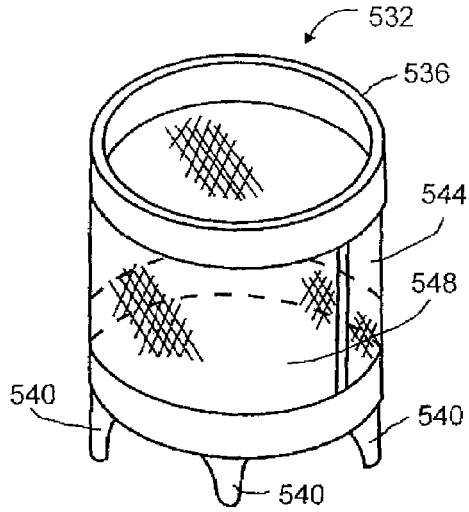
FIG. 16 is a perspective view of the play yard having a curved surrounding outer wall.

In a further variant of the invention, as illustrated in FIG. 15, a toy storage cover for a portable play yard 528 includes a portable play yard 532. The play yard 532, as illustrated in FIG. 16, includes a rigid frame 536 that has protruding feet 540, a surrounding side wall 544 and a floor 548 enclosed by the wall 544.

Figure 17:
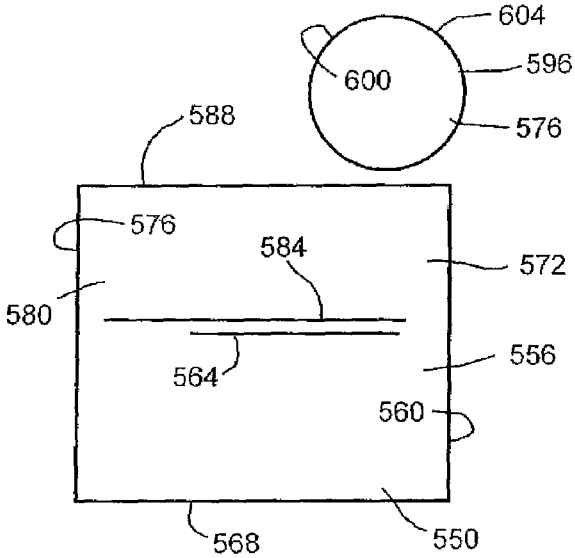
FIG. 17 is a plan view layout of the outer, inner and floor panels of the FIG. 15 embodiment.

As illustrated in FIGS. 15 and 17, the toy storage cover 528 includes an outer surrounding side panel 550 and an interior pocket 552. The outer surrounding side panel 550 has an exterior surface 556, an interior surface 560, a top edge 564 and a bottom edge 568. The interior pocket 552 includes an inner surrounding side panel 572 and a floor panel 576. The inner surrounding side panel 572 has an exterior surface 576, an interior surface 580, a top edge 584 and a bottom edge 588. The floor panel 592 has an upper surface 596, a lower surface 600 and a surrounding edge 604. The floor panel 592 is attached at its surrounding edge 604 to the bottom edge 588 of the inner surrounding side panel 572.

The inner surrounding side panel 572 is attached at its top edge 584 to the top edge 564 of the outer surrounding side panel 548. The outer surrounding side panel 548 is sized and shaped to fit slidably over the surrounding side wall 544 of the play yard 532. The inner surrounding side panel 572 and floor panel 576 are sized and shaped to fit slidably within the play yard walls 544. When the play yard 532 is located between the inner 572 and outer 548 surrounding side panels the interior pocket 552 will be supported by the play yard 532.

Figure 18:
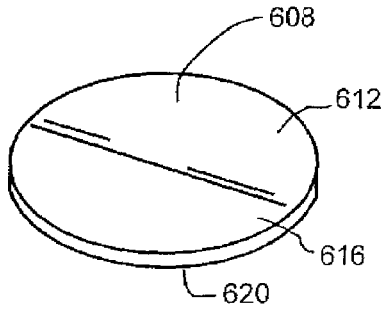
FIG. 18 is perspective view of the mattress pad retaining means for the FIG. 15 embodiment.

In still a further variant, as illustrated in FIG. 18, the toy storage cover for a portable play yard 528 further comprises a retaining means 608. The retaining means 608 is formed of rigid material 612 and is sized and shaped to fit frictionally within the inner surrounding side panel 572 and over the floor panel 576, thereby securing the interior pocket 552 downwardly within the play yard 532.

In yet a further variant, the retaining means 608 is a mattress pad 616 that has a rigid backing 620.

Figure 19:
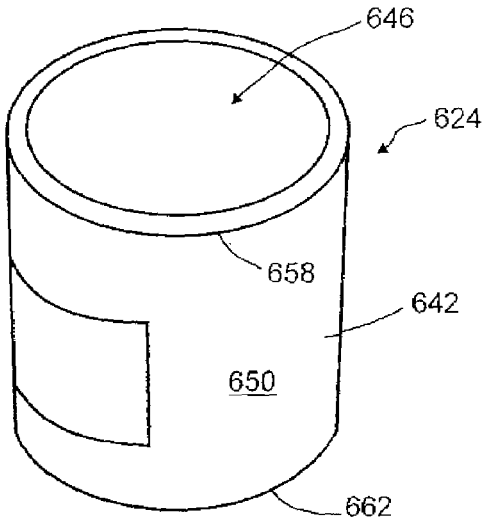
FIG. 19 is a perspective view of a fourth embodiment of the invention disposed upon an open topped container having a surrounding outer wall.
Figure 20:
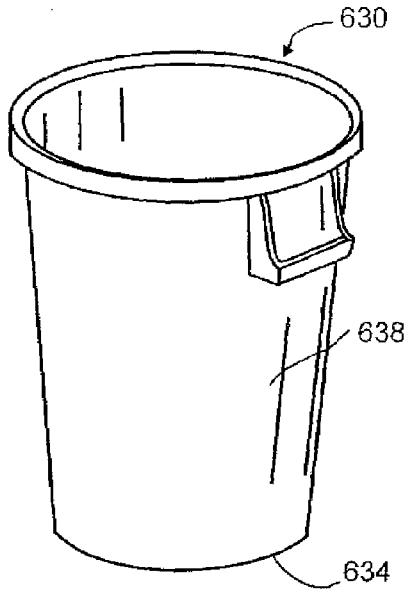
FIG. 20 is a perspective view of the open topped container.
Figure 21:
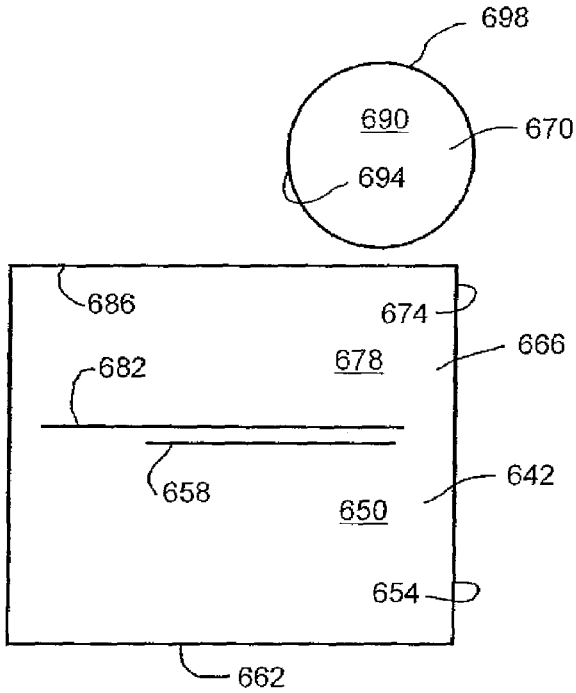
FIG. 21 is a plan view layout of the outer, inner and floor panels of the FIG. 19 embodiment.

In another variant of the invention, as illustrated in FIGS. 19 and 21, a toy storage cover for an open topped container 624 includes a container 630, as illustrated in FIG. 20, comprising a floor 634, a rigid surrounding side wall 638 extending upwardly from the floor 634. The toy storage cover 624, as illustrated in FIGS. 19 and 21, includes an outer surrounding side panel 642 and an interior pocket 646. The outer surrounding side panel 642 has an exterior surface 650, an interior surface 654, a top edge 658 and a bottom edge 662.

The interior pocket 646 includes an inner surrounding side panel 666 and a floor panel 670. The inner surrounding side panel 666 has an exterior surface 674, an interior surface 678, a top edge 682 and a bottom edge 686. The floor panel 670 has an upper surface 680, a lower surface 694 and a surrounding edge 698. The floor panel 670 is attached at its surrounding edge 698 to the bottom edge 686 of the inner surrounding side panel 666. The inner surrounding side panel 666 is attached at its top edge 682 to the top edge 658 of the outer surrounding side panel 642.

The outer surrounding side panel 642 is sized and shaped to fit slidably over the rigid surrounding side wall 638 of the container 630. The inner surrounding side panel 666 and floor panel 670 are sized and shaped to fit slidably within the container 630. When the container 630 is located between the inner 666 and outer 642 surrounding side panels the interior pocket 646 will be supported by the container 630.

Figure 22:
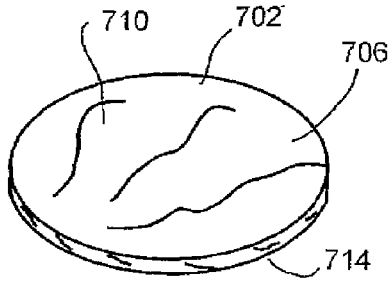
FIG. 22 is perspective view of the retaining means for the FIG. 19 embodiment.

In still another variant, as illustrated in FIG. 22, the toy storage cover for an open topped container 624 further comprises a retaining means 702. The retaining means 702 is formed of rigid material 706 and is sized and shaped to fit frictionally within the inner surrounding side panel 666 and over the floor panel 670, thereby securing the interior pocket 646 downwardly within the container 630.

In a further variant of the invention, as illustrated in FIG. 22, the retaining means 702 is a mattress pad 710 that has a rigid backing 714.

Figure 23:
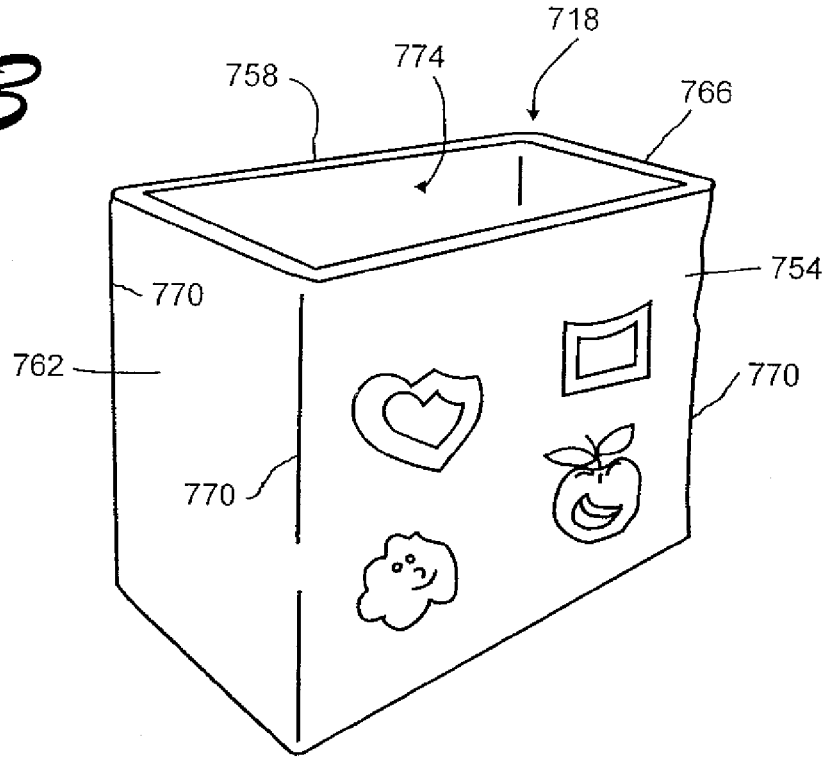
FIG. 23 is a perspective view of a fifth embodiment of the invention disposed upon a crib.
Figure 24:
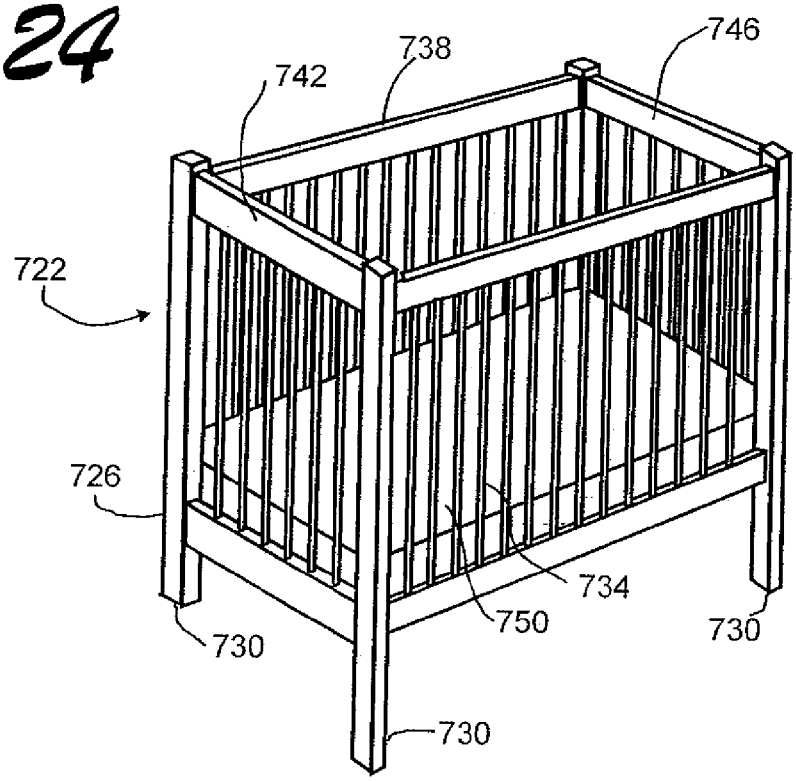
FIG. 24 is a perspective view of the crib.
Figure 25:
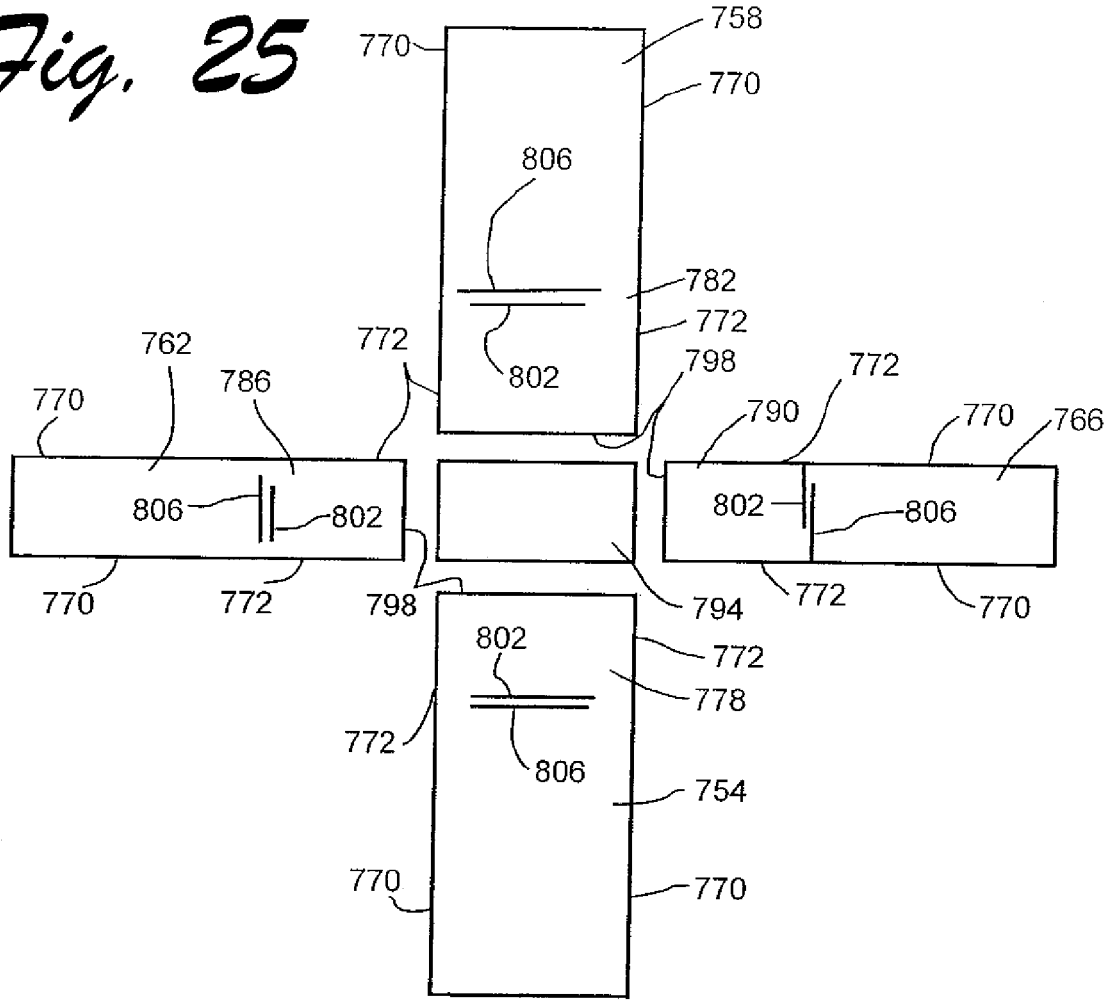
FIG. 25 is a plan view layout of the outer, inner and floor panels of the FIG. 23 embodiment.

In yet another variant, as illustrated in FIGS. 23 and 25, a toy storage cover for a crib 718 includes a crib 722. The crib 722, as illustrated in FIG. 24, includes a rigid frame 726 and has four protruding feet 730, a front wall 734, a back wall 738, a first side wall 742, a second side wall 746 and a floor 750 enclosed by the walls 734, 738, 742, 746. The toy storage cover 718, as illustrated in FIGS. 23 and 25, includes four outer panels 754, 758, 762, 766, an outer front panel 754, an outer back panel 758, an outer first side panel 762 and an outer second side panel 766. The outer panels 754, 758, 762, 766 are attached to each other at their side edges 770.

The toy storage cover 718 includes an interior pocket 774 that includes four inner panels 778, 782, 786, 790, an inner front panel 778, an inner back panel 782, an inner first side panel 786, and an inner second side panel 790 and a floor panel 794. The four inner panels 778, 782, 786, 790 are attached to each other at their side edges 772 and to the floor panel 794 at their bottom edges 798. The inner panels 778, 782, 786, 790 are attached at their top edges 802 to the top edges 806 of the outer panels 754, 758, 762, 766. The outer front 754, back 758, first side 762 and second side 766 panels are sized and shaped to fit slidably over the crib walls 734, 738, 742, 746 when attached together. The inner front 778, back 782, first side 786, second side 790 and floor 794 panels are sized and shaped to fit slidably within the crib walls 734, 738, 742, 746 when attached together. When the crib 718 is located between the inner 778, 782, 786, 790 and outer 754, 758, 762, 766 panels the interior pocket 774 will be supported by the crib 718.

Figure 26:
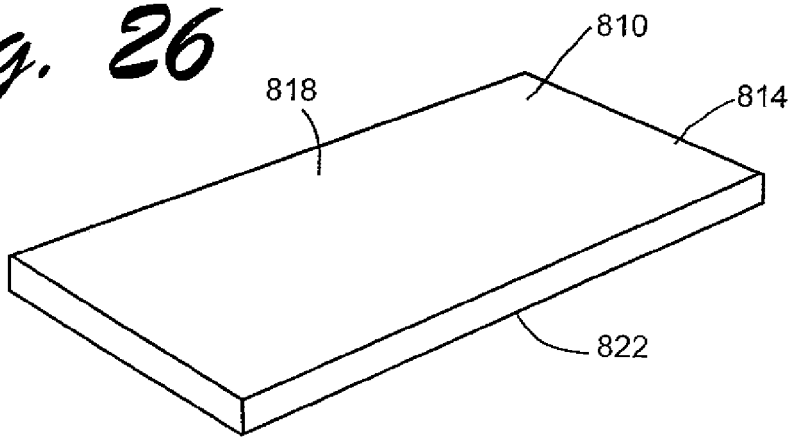
FIG. 26 is perspective view of the retaining means for the FIG. 23 embodiment.

In still another variant of the invention, as illustrated in FIG. 26, the toy storage cover for a crib 718 further comprises a retaining means 810. The retaining means 810 is formed of rigid material 814 and is sized and shaped to fit frictionally between the inner front 778, back 782, first side 786 and second side 790 panels and over the floor panel 794, thereby securing the interior pocket 774 downwardly within the crib 718.

In a further variant, the retaining means 810 is a mattress pad 818 has a rigid backing 822.

Figure 27:
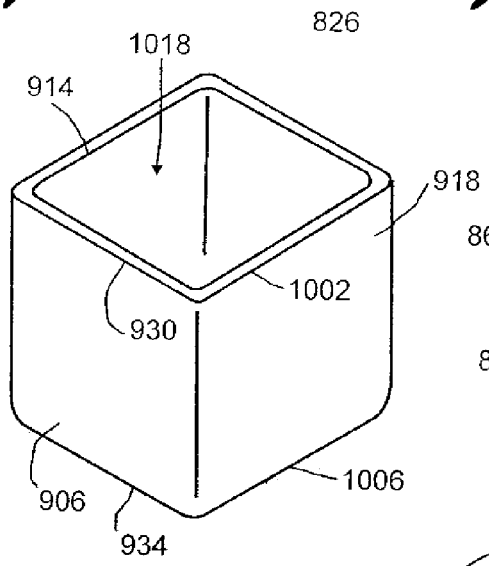
FIG. 27 is a perspective view of a sixth embodiment of the invention disposed upon a collapsible open topped container.
Figure 28:
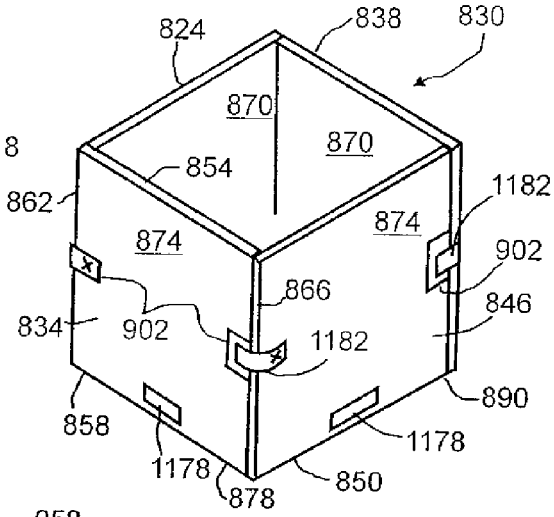
FIG. 28 is a perspective view of the collapsible container.
Figure 29:
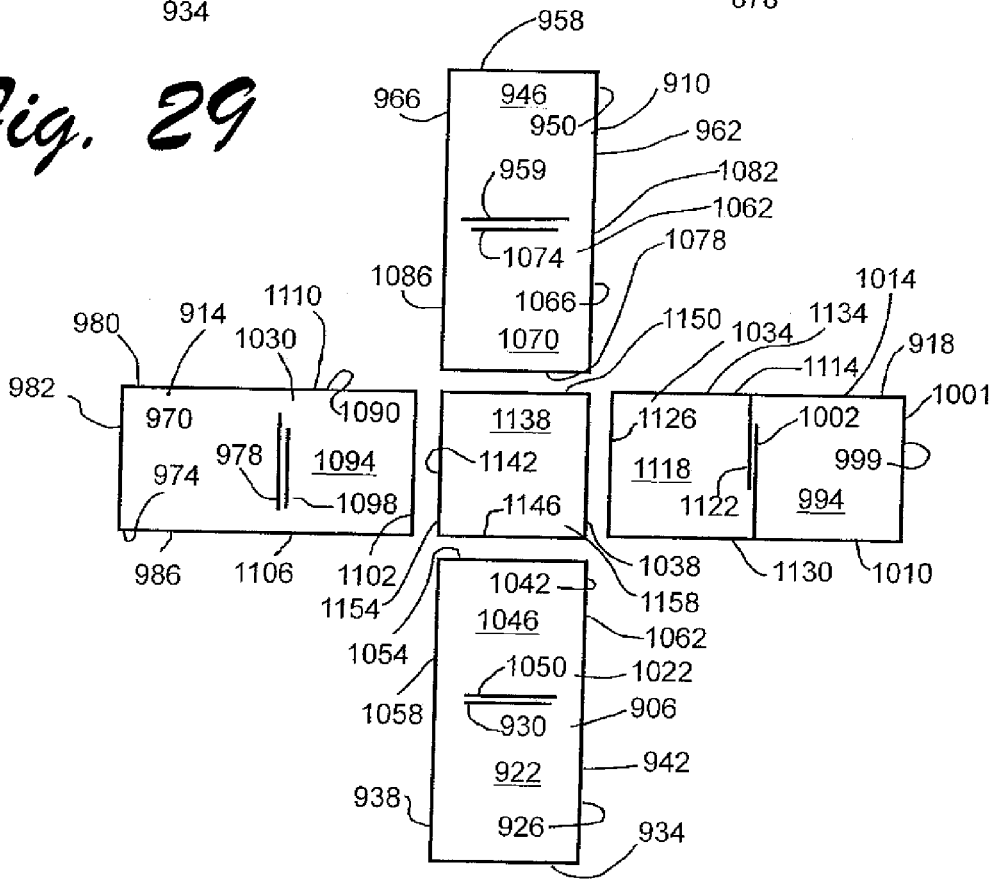
FIG. 29 is a plan view layout of the outer, inner and floor panels of the FIG. 27 embodiment.

In another variant of the invention, as illustrated in FIGS. 27 and 29, a toy storage cover for a collapsible open topped container 826 includes a container 830. The container 830, as illustrated in FIG. 28, includes a front wall 834, a back wall 838, a first side wall 842, a second side wall 846 and a floor 850 enclosed by the walls 834, 838, 842, 846. Each of the walls 834, 838, 842, 846 has a top edge 854, a bottom edge 858, a first side edge 862, a second side edge 866, an inner surface 870 and an outer surface 874. The floor 850 has a front edge 878, a back edge (not shown), a first side edge (not shown), a second side edge 890, a top surface (not shown) and a bottom surface (not shown).

The front wall 834 is hingedly attached at its bottom edge 858 to the front edge 878 of the floor 850 and the back wall 838 is hingedly attached at its bottom edge 858 to the back edge of the floor 850. The first side wall 842 is hingedly attached at its bottom edge 858 to the first side edge of the floor 850 and the second side wall 846 is hingedly attached at its bottom edge 858 to the second side edge 890 of the floor 850.

Means 902 are provided for removably attaching the front wall 834 at its first side edge 862 to the first side wall 842 at its second side edge 866. Means 902 are provided for removably attaching the front wall 834 at its second side edge 866 to the second side wall 846 at its first side edge 862. Means 902 are provided for removably attaching the back wall 838 at its second side edge 866 to the first side wall 842 at its first side edge 862. Means 902 are provided for removably attaching the back wall 838 at its first side edge 862 to the second side wall 846 at its second side edge 866.

The toy storage cover 826, as illustrated in FIGS. 27 and 29, includes four outer panels 906, 910, 914, 918. The outer front panel 906 has an exterior surface 922, an interior surface 926, a top edge 930, a bottom edge 934, a first side edge 938, and a second side edge 942. The outer back panel 910 has an exterior surface 946, an interior surface 950, a top edge 954, a bottom edge 958, a first side edge 962, and a second side edge 966. The outer first side panel 914 has an exterior surface 970, an interior surface 974, a top edge 978, a bottom edge 982, a front side edge 986, and a back side edge 990. The outer second side panel 918 has an exterior surface 994, an interior surface 998, a top edge 1002, a bottom edge 1006, a front side edge 1010, and a back side edge 1014.

The outer front panel 906 is joined at its first side edge 938 to the front side edge 986 of the outer first side panel 914 and is joined at its second side edge 942 to the front side edge 1010 of the outer second side panel 918. The outer back panel 910 is joined at its first side edge 962 to the back side edge 990 of the outer first side panel 914 and is joined at its second side edge 966 to the back side edge 1014 of the outer second side panel 918.

An interior pocket 1018 is provided. The interior pocket 1018 includes four inner panels 1022, 1026, 1030, 1034 and a floor panel 1038. The inner front panel 1022 has an exterior surface 1042, an interior surface 1046, a top edge 1050, a bottom edge 1054, a first side edge 1058, and a second side edge 1062. The inner back panel 1026 has an exterior surface 1066, an interior surface 1070, a top edge 1074, a bottom edge 1078, a first side edge 1082, and a second side edge 1086. The inner first side panel 1030 has an exterior surface logo, an interior surface 1094, a top edge 1098, a bottom edge 1102, a front side edge 1106, and a back side edge 1110. The inner second side panel 1034 has an exterior surface 1114, an interior surface 1118, a top edge 1122, a bottom edge 1126, a front side edge 1130, and a back side edge 1134.

The inner front panel 1022 is joined at its first side edge 1058 to the front side edge 1106 of the inner first side panel 1030 and is joined at its second side edge 1062 to the front side edge 1130 of the inner second side panel 1034. The inner back panel 1026 is joined at its first side edge 1082 to the back side edge 1110 of the inner first side panel 1030 and is joined at its second side edge 1086 to the back side edge 1134 of the inner second side panel 1034.

The floor panel 1038 has an upper surface 1138, a lower surface 1142, a front edge 1146, a back edge 1150, a first side edge 1154 and a second side edge 1158. The floor panel 1038 is attached at its front edge 1146 to the bottom edge 1054 of the inner front panel 1022, at its back edge 1150 to the bottom edge 1078 of the inner back panel 1026, at its first side edge 1154 to the bottom edge 1102 of the inner first side panel 1030 and at its second side edge 1158 to the bottom edge 1126 of the inner second side panel 1034. The inner front panel 1022 is attached at its top edge 1050 to the top edge 930 of the outer front panel 906. The inner back panel 1026 is attached at its top edge 1074 to the top edge 954 of the outer back panel 910. The inner first side panel 1030 is attached at its top edge 1098 to the top edge 978 of the outer first side panel 914. The inner second side panel 1034 is attached at its top edge 1122 to the top edge 1002 of the outer second side panel 918.

The outer front 906, back 910, first side 914 and second side 918 panels are sized and shaped to fit slidably over the container walls 834, 838, 842, 846 when attached together. The inner front 1022, back 1026, first side 1030, second side 1034 and floor 1038 panels are sized and shaped to fit slidably within the container walls 834, 838, 842, 846 when attached together. When the container 830 is located between the inner 1022, 1026, 1030, 1034 and outer 906, 910, 914, 918 panels the interior pocket 1018 will be supported by the container 830.

Figure 30:
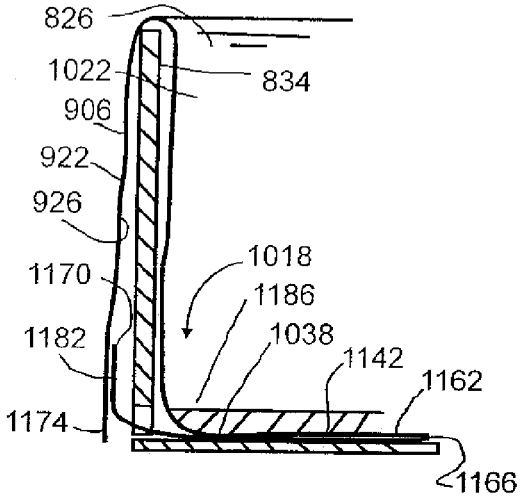
FIG. 30 is a plan view of an attachment strap affixed to the lower surface of the floor panel of the FIG. 27 embodiment.
Figure 30A:
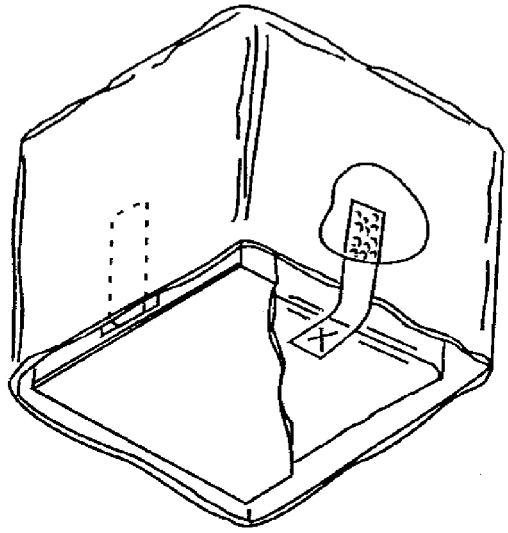
FIG. 30*a* is a partial cut-away perspective view of an attachment strap affixed to the lower surface of the floor panel of the FIG. 27 embodiment.

In still another variant, as illustrated in FIGS. 30 and 30*a*, the toy storage cover 826 includes at least one attachment strap 1162. The attachment strap 1162 has a first end 1166 and a second end 1170 and is fixedly attached at its first end 1166 to the lower surface 1142 of the floor panel 1038 of the interior pocket 1018. The strap 1162 extends outwardly past one of the inner panels 1022, 1026, 1030, 1034. The second end 1170 of the attachment strap 1162 includes means 1174 for removably attaching the second end 1170 to either the exterior surface 922, 946, 970, 994 or the interior surface 926, 950, 974, 998 of one of the outer panels 906,910, 914, 918.

The container 830, as illustrated in FIG. 28, includes at least one slot 1178. The slot 1178 is sized, shaped and located adjacent the bottom edge 858 of one of the walls 834, 838, 842, 846 of the collapsible container 830 so as to permit the second end 1170 of the attachment strap 1162 to pass through it. When the second end 1170 of the attachment strap 1162 is passed through the slot 1178 and removably attached to either the exterior surface 922, 946, 970, 994 or the interior surface 926, 950, 974, 998 of at least one of the outer panels 906, 910, 914, 918, the interior pocket 1018 of the toy storage cover 826 will be removably secured to the collapsible container 830.

In yet another variant, as illustrated in FIG. 28, the means 902 for removably attaching the front 834 and back 838 walls of the container 830 to the first 842 and second 846 side walls of the container 830 includes hooking and loop elements 1182 secured to either the inner surface 870 or the outer surface 874 of the walls 834, 838, 842, 846 adjacent their side edges 862, 866.

In a further variant of the invention, as illustrated in FIG. 30, the means 1174 for removably attaching the second end 1170 of the attachment strap 1162 to either the exterior surface 922, 946, 970, 994 or the interior surface 926, 950, 974, 998 of one of the outer panels 906, 910, 914, 918 includes hooking and loop elements 1182 secured to the second end 1170 and either the exterior surface 922, 946, 970, 994 or the interior surface 926, 950, 974, 998 of at least one of the outer panels 906, 910, 914, 918.

Figure 31:
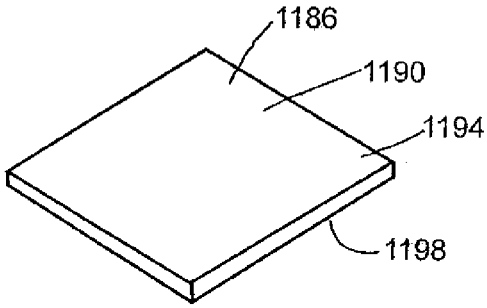
FIG. 31 is perspective view of the retaining means for the FIG. 27 embodiment.

In still a further variant, as illustrated in FIG. 31, a retaining means 1186 is provided. The retaining means 1186 is formed of rigid material 1190 and is sized and shaped to fit frictionally between the inner front 1022, back 1026, first side 1030 and second side 1034 panels and over the floor panel 1038, thereby securing the interior pocket 1018 downwardly within the container 830.

In yet a further variant, the retaining means 1186 is a mattress pad 1194 that has a rigid backing 1198.

Figure 32:
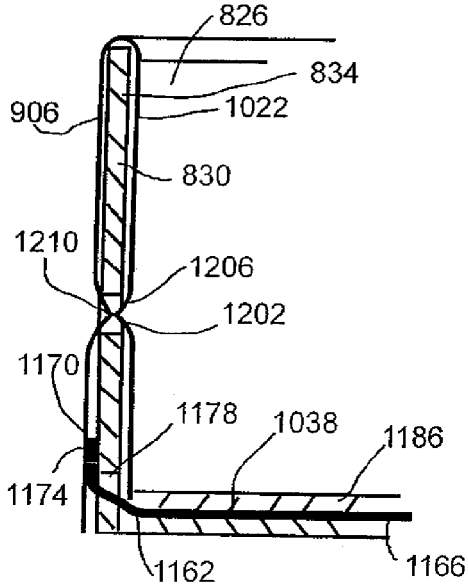
FIG. 32 is a perspective view of the FIG. 27 embodiment illustrating attachment of the outer panels to the inner panels through openings in the container walls.

In another variant of the invention, as illustrated in FIG. 32, the toy storage cover for a collapsible open topped container 826 includes means 1202 for securing the toy storage cover 826 to the container 830.

In a final variant, as illustrated in FIG. 32, the means 1202 for securing the toy storage cover 826 to the container 830 comprises means 1206 for fastening at least one of the outer panels 906, 910, 914, 918 to one of the inner panels 1022, 1026, 1030, 1034 through openings 1210 in the container walls 834, 838, 842, 846.

Those of ordinary skill in the art may recognize that many modifications and variations of the present invention may be implemented without departing from the spirit or scope of the invention. Thus, it is intended that the present invention covers the modifications and variations of this invention provided they come within the scope of the appended claims and their equivalents.

What is claimed is:

1. A toy storage cover for a collapsible open topped container, comprising:

a container, said container comprising a floor having a front edge, a back edge, a first side edge and a second side edge, a front wall, a back wall, a first side wall and a second side wall, each of the container walls having a top edge, a bottom edge, a first side edge and a second side edge;

said front wall being removably attached at its bottom edge to the front edge of the floor;

said back wall being removably attached at its bottom edge to the back edge of the floor;

said first side wall being removably attached at its bottom edge to the first side edge of the floor;

said second side wall being removably attached at its bottom edge to the second side edge of the floor;

a cover having an outer front panel, an outer back panel, an outer first side panel, and an outer second side panel;

said outer front panel having an exterior surface, an interior surface, a top edge, a bottom edge, a first side edge, and a second side edge;

said outer back panel having an exterior surface, an interior surface, a top edge, a bottom edge, a first side edge, and a second side edge;

said outer first side panel having an exterior surface, an interior surface, a top edge, a bottom edge, a front side edge, and a back side edge;

said outer second side panel having an exterior surface, an interior surface, a top edge, a bottom edge, a front side edge, and a back side edge;

said outer front panel being joined at its first side edge to the front side edge of the outer first side panel and being joined at its second side edge to the front side edge of the outer second side panel;

said outer back panel being joined at its first side edge to the back side edge of the outer first side panel and being joined at its second side edge to the back side edge of the outer second side panel;

an interior pocket, said interior pocket comprising:

an inner front panel, said inner front panel having an exterior surface, an interior surface, a top edge, a bottom edge, a first side edge, and a second side edge;

an inner back panel, said inner back panel having an exterior surface, an interior surface, a top edge, a bottom edge, a first side edge, and a second side edge;

an inner first side panel, said inner first side panel having an exterior surface, an interior surface, a top edge, a bottom edge, a front side edge, and a back side edge;

an inner second side panel, said inner second side panel having an exterior surface, an interior surface, a top edge, a bottom edge, a front side edge, and a back side edge;

said inner front panel being joined at its first side edge to the front side edge of the inner first side panel and being joined at its second side edge to the front side edge of the inner second side panel;

said inner back panel being joined at its first side edge to the back side edge of the inner first side panel and being joined at its second side edge to the back side edge of the inner second side panel;

a floor panel, said floor panel having an upper surface, a lower surface, a front edge, a back edge, a first side edge and a second side edge;

said floor panel being attached at its front edge to the bottom edge of the inner front panel, at its back edge to the bottom edge of the inner back panel, at its first side edge to the bottom edge of the inner first side panel and at its second side edge to the bottom edge of the inner second side panel;

said inner second side panel being attached at its top edge to the top edge of the outer second side panel; said outer front, back, first side and second side panels being sized and shaped to fit slidably over the container walls when attached together;

said inner front, back, first side, second side and floor panels being sized and shaped to fit slidably within the container walls when attached together; and whereby, when the container is disposed between said inner and outer panels the interior pocket will be supported by the container;

further comprising a retaining means, said retaining means being formed of rigid material and being sized and shaped to fit frictionally between the inner front, back, first side and second side panels and over the floor panel, thereby securing the interior pocket downwardly within the container.

2. A toy storage cover for a collapsible open topped container as described in claim 1, wherein the retaining means is a mattress pad having a rigid backing.

3. A toy storage cover for a collapsible open topped container as described in claim 1, further comprising means for securing the toy storage cover to the container.

4. A toy storage cover for a collapsible open topped container as described in claim 3, wherein said means for securing said toy storage cover to said container comprises fastening at least one of said outer panels to one of said inner panels through openings in said container walls.

5. A toy storage cover for a collapsible open topped container as described in claim 1, further comprising a plurality of exterior pockets attached to said outer panels.

6. A toy storage cover for a collapsible open topped container as described in claim 1, wherein said outer and inner panels are composed of a see through material.

7. A toy storage cover for collapsible open topped container, comprising:

a container, said container comprising a floor removably attached to a front wall, a back wall, a first side wall and a second side wall;

a cover having an outer surrounding side panel, said outer surrounding side panel having an exterior surface, an interior surface, a top edge and a bottom edge;

an interior pocket, said interior pocket comprising:

an inner surrounding side panel, said inner surrounding side panel having an exterior surface, an interior surface, a top edge and a bottom edge;

a floor panel, said floor panel having an upper surface, a lower surface and a surrounding edge;

said floor panel being attached at its surrounding edge to the bottom edge of the inner surrounding side panel;

said inner surrounding side panel being attached at its top edge to the top edge of the outer surrounding side panel;

said outer surrounding side panel being sized and shaped to fit slidably over the container walls;

said inner surrounding side panel and floor panel being sized and shaped to fit slidably within the container walls; and whereby, when the container is disposed between said inner and outer surrounding side panels the interior pocket will be supported by the container;

further comprising a retaining means, said retaining means being formed of rigid material and being sized and shaped to fit frictionally within the inner surrounding side panel and over the floor panel, thereby securing the interior pocket downwardly within the container.

8. A toy storage cover for a collapsible open topped container as described in claim 7, wherein the retaining means is a mattress pad having a rigid backing.

9. A toy storage cover for a collapsible open topped container as described in claim 7, further comprising means for securing the toy storage cover to the container.

10. A toy storage cover for a collapsible open topped container as described in claim 9, wherein said means for securing said toy storage cover to said container comprises fastening at least one of said outer panels to one of said inner panels through openings in said container walls.

11. A toy storage cover for a collapsible open topped container as described in claim 7, further comprising a plurality of exterior pockets attached to said outer panels.

12. A toy storage cover for a collapsible open topped container as described in claim 7, wherein said outer and inner panels are composed of a see through material.

13. A toy storage cover for a collapsible open topped container, comprising:

a container, said container comprising a floor removably attached to a front wall, a back wall, a first side wall and a second side wall;

outer front, back and side panels, wherein said outer front, back and side panels are attached at their respective edges;

an interior pocket, said interior pocket comprising:

inner front, back and side panels, wherein said inner front, back and side panels are attached at their respective edges;

a floor panel, wherein said floor panel is attached to said inner front, back and side panels;

wherein said inner front panel is attached to said outer front panel, said inner back panel is attached to said outer back panel, and said inner side panels are attached to said outer side panels;

wherein said attached outer front, back and side panels are sized and shaped to fit slidably over said container walls, and wherein said attached inner front, back, side and floor panels are sized and shaped to fit slidably within said container walls; and whereby, when said container is disposed between said inner and outer panels, said interior pocket is supported by said container;

further comprising means for securing said toy storage cover to said container.

14. The toy storage cover according to claim 13 wherein said means for securing said toy storage cover to said container comprises fastening at least one of said outer panels to one of said inner panels through openings in said container walls.

15. The toy storage cover according to claim 13 further comprising a plurality of exterior pockets attached to said outer panels.

16. The toy storage cover according to claim 13, wherein at least one of said plurality of exterior pockets further comprises at least one of a smaller interior pocket and a smaller exterior pocket.

17. The toy storage cover according to claim 13 wherein said outer and inner panels are composed of a see through material.

* * * * *